US005714991A

United States Patent [19]

Osborne et al.

[11] Patent Number: 5,714,991

[45] Date of Patent: Feb. 3, 1998

[54] ROTARY PRIMING SYSTEM FOR INKJET PRINTHEADS

[75] Inventors: William S. Osborne, Vancouver; Patrick J. Therien, Battle Ground; Bret K. Taylor, Vancouver, all of Wash.

[73] Assignee: Hewlett-Packard Company, Palo Alto, Calif.

[21] Appl. No.: 398,015

[22] Filed: Mar. 3, 1995

[51] Int. Cl.[6] ..... B41J 2/165

[52] U.S. Cl. ..... 347/30; 347/32; 347/33

[58] Field of Search ..... 347/30, 32, 33

[56] References Cited

U.S. PATENT DOCUMENTS

| | | | |
|---|---|---|---|
| 3,820,445 | 6/1974 | Klink . | |
| 3,926,211 | 12/1975 | MacLarty . | |
| 4,162,501 | 7/1979 | Mitchell et al. . | |
| 4,272,052 | 6/1981 | Gidner . | |
| 4,372,208 | 2/1983 | Legardinier . | |
| 4,488,702 | 12/1984 | Lapeyre . | |
| 4,785,719 | 11/1988 | Bachschmid et al. . | |
| 4,853,717 | 8/1989 | Harmon et al. | 346/140 R |
| 4,872,813 | 10/1989 | Gorton et al. . | |
| 5,051,761 | 9/1991 | Fisher et al. . | |
| 5,055,856 | 10/1991 | Tomii et al. | 346/1.1 |
| 5,103,244 | 4/1992 | Gast et al. | 346/1.1 |
| 5,108,373 | 4/1992 | Bancsi et al. . | |
| 5,115,250 | 5/1992 | Harmon et al. | 346/1.1 |
| 5,146,243 | 9/1992 | English et al. | 346/140 R |
| 5,151,715 | 9/1992 | Ward et al. | 346/140 R |
| 5,153,613 | 10/1992 | Yamaguchi et al. . | |
| 5,155,497 | 10/1992 | Martin et al. | 346/1.1 |
| 5,185,614 | 2/1993 | Courian et al. | 346/1.1 |
| 5,252,993 | 10/1993 | Tomii et al. | 346/140 R |
| 5,260,724 | 11/1993 | Tomii et al. | 346/140 R |
| 5,448,270 | 9/1995 | Osborne | 347/29 |
| 5,517,220 | 5/1996 | English | 347/29 |
| 5,534,896 | 7/1996 | Osborne | 347/29 |
| 5,587,729 | 12/1996 | Lee et al. | 347/32 |

FOREIGN PATENT DOCUMENTS

| | | | |
|---|---|---|---|
| 0552030 | 7/1993 | European Pat. Off. | B41J 2/165 |
| 590850-A2 | 4/1994 | European Pat. Off. | B41J 2/165 |
| 59-209876 | 11/1984 | Japan | B41J 3/04 |
| 406191061 | 7/1994 | Japan | 347/29 |

OTHER PUBLICATIONS

HP Patent Application Ser, No. 08/094,634, Filed Jul. 19, 1993, "Tubeless Ink-Jet Printer Priming Cap And System".

Hewlett-Packard Patent: Application S/N 08/382473 filed Jan. 31, 1995.

*Primary Examiner*—Benjamin R. Fuller
*Assistant Examiner*—Thien Tran
*Attorney, Agent, or Firm*—Flory L. Martin

[57] ABSTRACT

A rotary priming service station system is provided for priming inkjet printheads in an inkjet printing mechanism. A platform pivoted to a rotatable tumbler supports a plunger-actuated rolling diaphragm cap. A trigger mechanism is pivoted to the sled to actuate the cap plunger, which pulls down on the cap to draw a negative priming pressure on the nozzles when the cap is sealed against the printhead. A retractable stand-off finger project through the sled to separate the diaphragm cap from the printhead until the cap begin to draw the negative priming pressure. Through tumbler rotation and printhead motion, the trigger mechanism is cocked and activated. The platform supports a wiper that performs a fast post-prime wipe of the printhead. The tumbler rotates the cap and wiper against a blotting mechanism to blot away any primed ink residue. A method is also provided for priming inkjet printheads in an inkjet printing mechanism.

49 Claims, 13 Drawing Sheets

FIG. 12
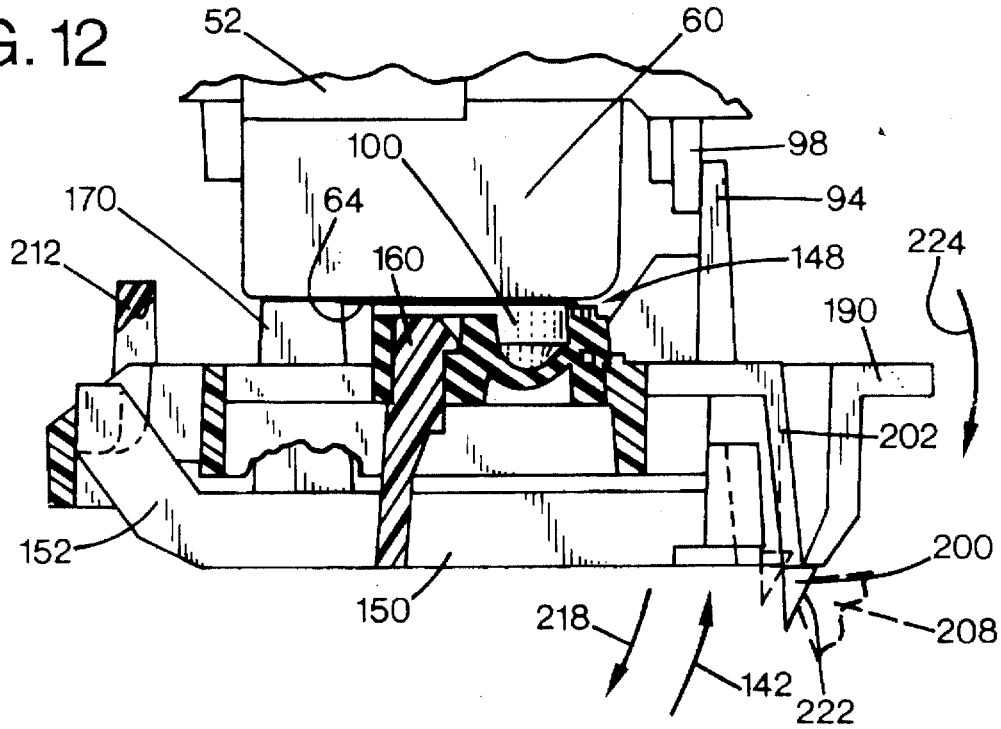
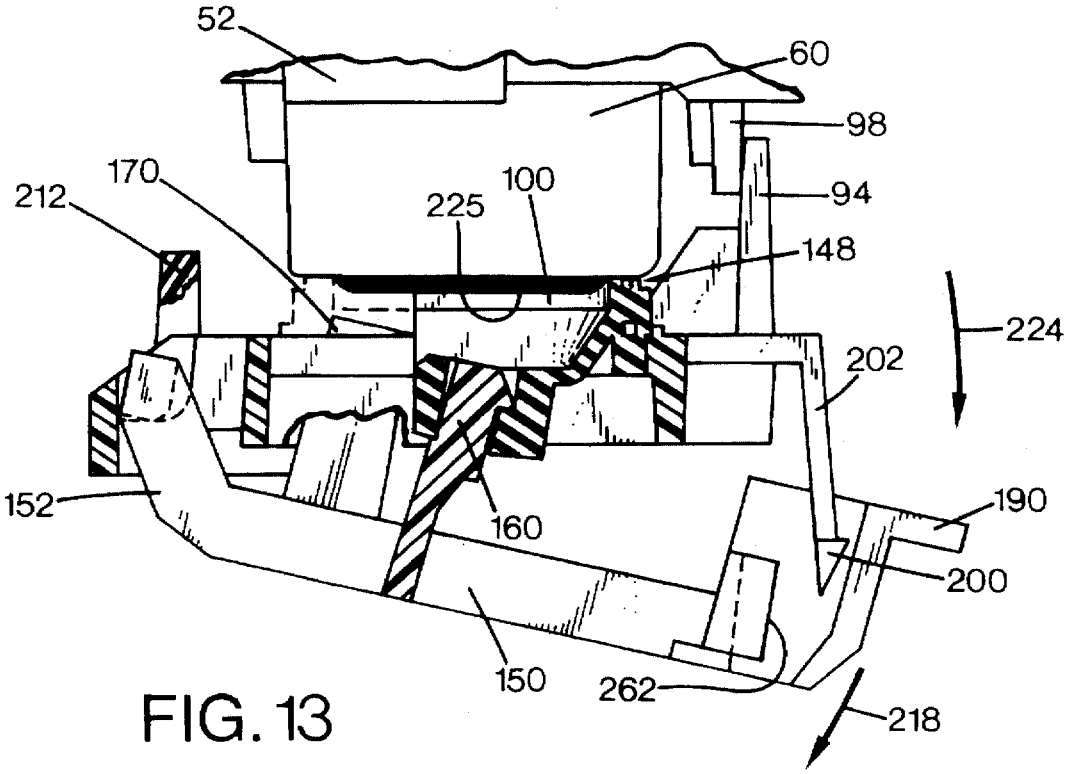
FIG. 13

ROTARY PRIMING SYSTEM FOR INKJET PRINTHEADS

FIELD OF THE INVENTION

The present invention relates generally to inkjet printing mechanisms, and more particularly to a rotary priming system for priming inkjet printheads, and to a new printhead priming method.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which humidically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide faster, more waterfast printing with darker blacks and more vivid colors, pigment based inks have been developed. These pigment based inks have a higher solid content than the earlier dye based inks. Both types of ink dry quickly, which allows inkjet printing mechanisms to use plain paper. To provide high quality hard copy printed images with both dark blacks and vivid colors, current printer designs employ a black pen, and a single tri-color pen, or a black pen in combination with three monochrome color pens.

Earlier printers used priming systems that required expensive valves, pumps or other elaborate systems. Many of these earlier drop on demand inkjet printers had priming systems which were over-designed and costly, such as printers having permanent or semi-permanent printheads, which required priming pumps. These priming pumps had to draw high volumes of ink through these permanent and semi-permanent printheads to provide an adequate prime. Other printers stored ink remote from the printheads, then required that enough ink be pumped to completely fill a piping system from the ink reservoir to the printhead. Both of these systems were incapable of supplying a high vacuum pressure of a short pressure pulse duration with a simple and economical system.

Some other printers needed a positively pressured ink supply to push the ink through the printhead. In the past, the priming receptacles were usually drained onto a nearby absorbent pad, which wicked ink away through capillary action, or upon which ink drained under the force of gravity. There have also been printers capable of doing a post prime wipe rapidly, for a single printhead, but requiring many costly components to implement the system.

SUMMARY OF THE INVENTION

According to one aspect of the present invention, a service station is provided for servicing an inkjet printhead of an inkjet printing mechanism. The printhead has a face plate with nozzles extending therethrough that selectively eject ink. The station includes a platform that is moveable to a priming position. A diaphragm is supported by the platform to seal the face plate when the platform is moved into the priming position. The station also includes a trigger mechanism coupled to the diaphragm. The trigger mechanism is operable to move the diaphragm to draw a negative priming pressure on the nozzles when sealed against the face plate to prime the printhead.

In an illustrated embodiment, the service station also includes a tumbler that is rotatable around a first axis. The platform is pivoted to the tumbler by a link for movement to the priming position. A stand-off mechanism is coupled to the trigger mechanism to delay sealing by separating the diaphragm from the face plate until the diaphragm begins to move to draw the negative priming pressure. A wiper is supported by the platform to wipe the face plate when moved into a wiping position. The service station also includes a blotting mechanism that is engageable with the diaphragm to absorb at least a portion of any primed ink from the diaphragm.

According to another aspect of the invention, a method is provided of priming an inkjet printhead of an inkjet printing mechanism. The method includes the step of cocking a trigger mechanism to place a diaphragm configured to surround the nozzles and seal the face plate into a cocked pre-prime position. In a moving step, the diaphragm is moved into a priming position. The method also includes the step of releasing the cocked trigger mechanism to induce diaphragm movement that draws a negative priming pressure on the nozzles when the diaphragm is in the priming position.

An overall goal of the present invention is to provide an inkjet printing mechanism which uses a rotary inkjet printhead priming system, including a primer cap blotting system.

Another goal of the present invention is to provide a high quality hardcopy output using an economical inkjet printing mechanism.

A further goal of the present invention is to provide a method of priming a pair of inkjet pens in a printing mechanism, as well as blotting the priming apparatus to prepare for the next printing job.

BRIEF DESCRIPTION OF THE DRAWING

FIGS. 10–14 are cross sectional side elevational views of the rotary priming system of FIG. 1 taken along the line 10—10 of FIG. 3, showing various stages of one form of a priming method of the present invention.

DETAILED DESCRIPTION OF A PREFERRED EMBODIMENT

Figure 1:
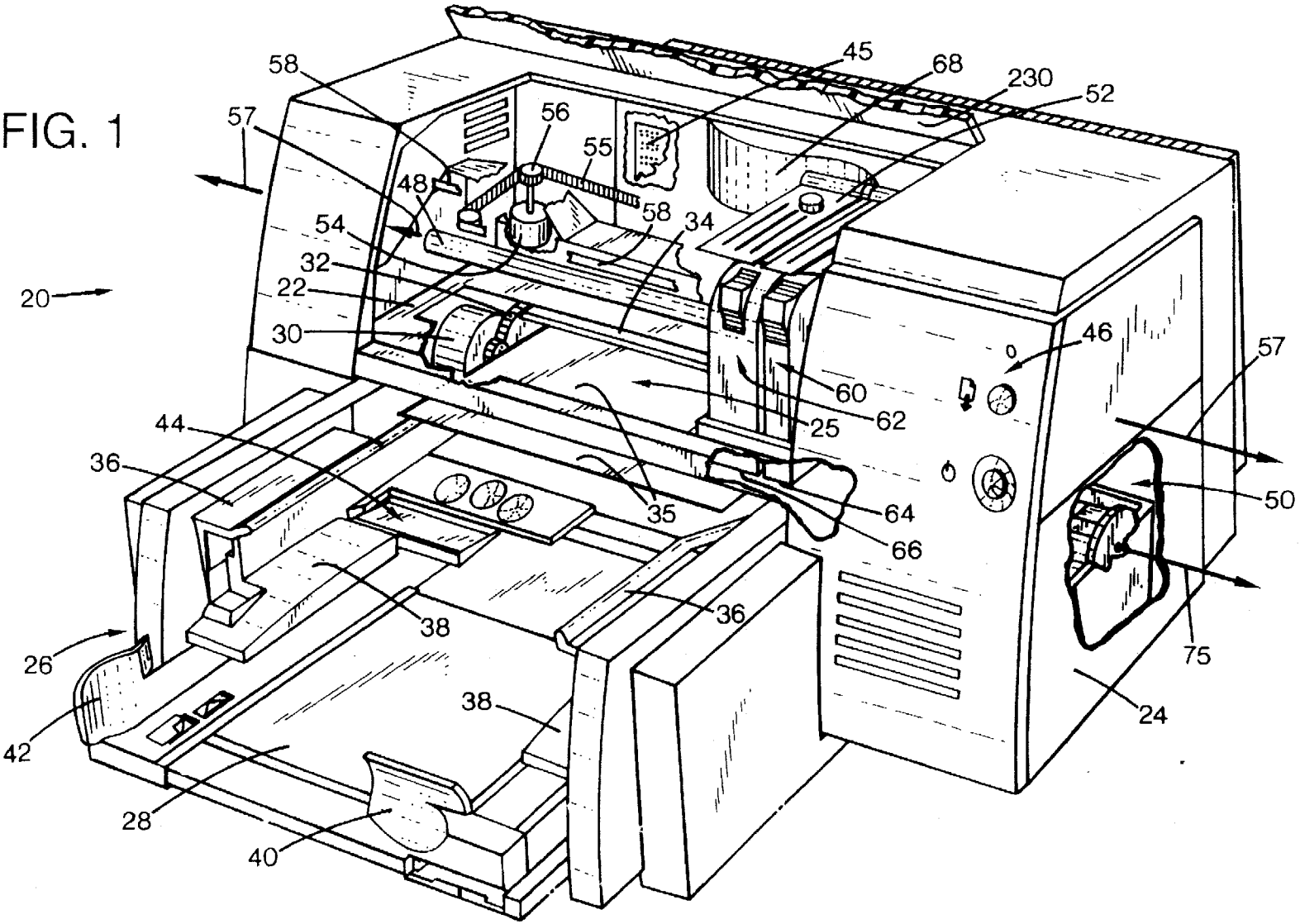
FIG. 1 is a fragmented perspective view of an inkjet printing mechanism incorporating one form of a service station having a rotary priming system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, foils, and the like, but for convenience, the illustrated embodiment is described using paper as the print medium. The print media handling system 26 has a feed tray 28 for storing sheets of paper before printing. A series of conventional paper drive rollers (not shown), driven by a stepper motor 30 and drive gear assembly 32, may be used to move the print media from tray 28 under a paper guide member 34 into the print zone 25, as shown for sheet 35, for printing.

After printing, the motor 32 drives the printed sheet 35 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to extend across the print zone 25 and a service station 50. The guide rod 48 slideably supports an inkjet pen carriage 52 for travel back and forth across the print zone 25 and the service station 50. A carriage stepper motor 54 is coupled to an endless belt 55 by a drive gear 56 to drive the carriage along the guide rod 48, which defines a scanning axis 57 for the carriage 52. The motor 54 operates in response to control signals received from the controller 45. The belt 55 may be secured in a conventional manner to the carriage 52 to incrementally advance the carriage along guide rod 48 in response to rotation of motor 54.

To provide feedback information to printer controller 45 regarding the carriage position, an encoder strip 58 extends along the length of the print zone 25 and over the service station area 50. A conventional optical encoder reader (not shown) may be mounted to the carriage 52 to read positional information provided by the encoder strip 58. The manner of attaching the belt 55 to the carriage 52, as well as the manner of providing positional feedback information via the encoder strip reader, may be accomplished in a variety of different ways known to those skilled in the art.

In the print zone 25, the media sheet 35 receives ink from an inkjet cartridge, such as a black ink cartridge or pen 60, and/or a color ink cartridge or pen 62. The illustrated color pen 62 is a tri-color pen, although in some embodiments, three discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as hydrocarbon based inks, as well as hybrid or composite inks having both dye and pigment characteristics.

The illustrated pens 60, 62 each include reservoirs for storing a supply of ink therein. The pens 60, 62 have printheads 64, 66 respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multi-conductor strip 68 from the controller 45 to the printhead carriage 52.

Priming System

Figure 2:
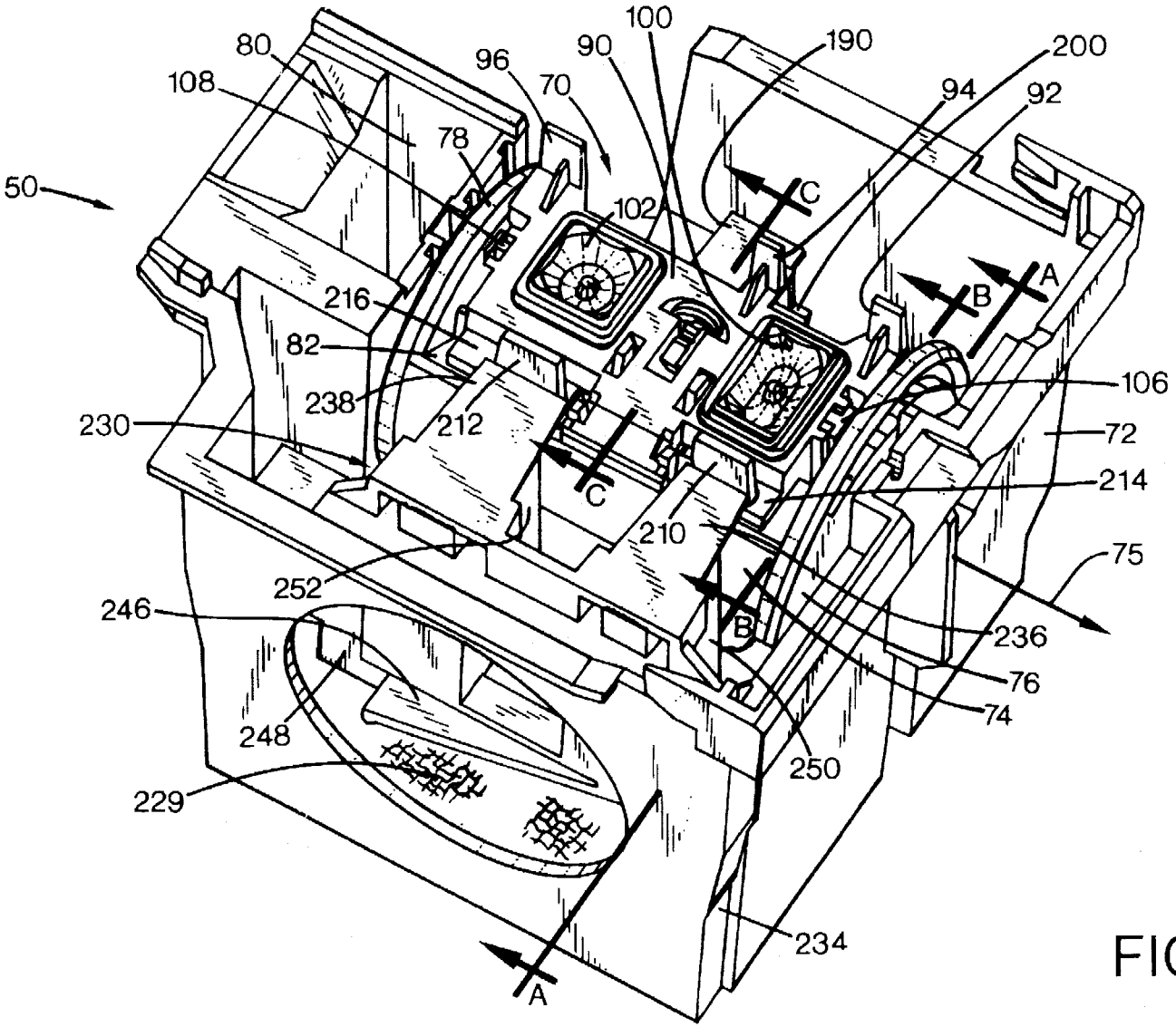
FIG. 2 is a front perspective view of the service station with the rotary priming system of FIG. 1, shown removed from the printing mechanism.
Figure 3:
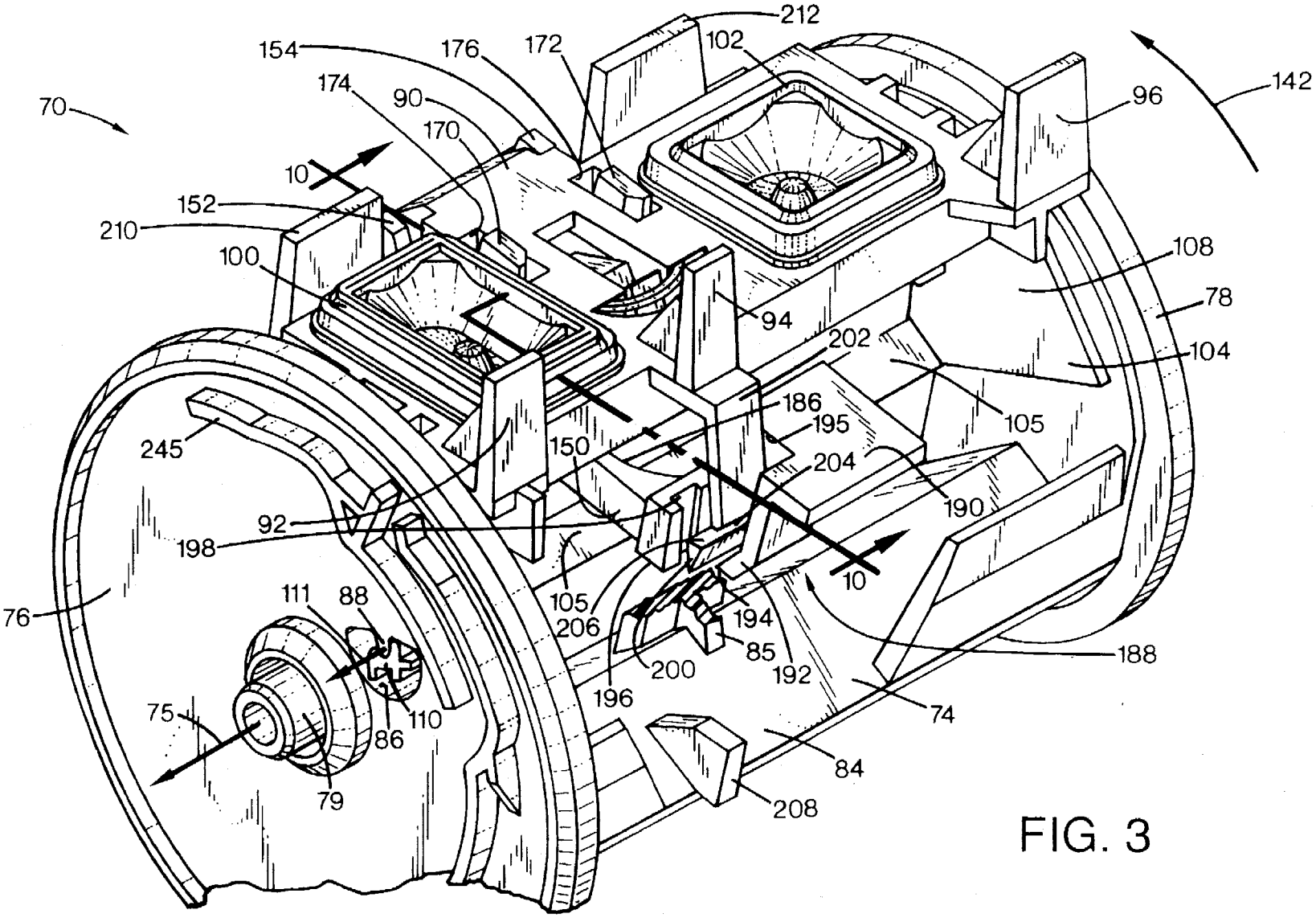
FIG. 3 is a partially fragmented perspective view showing a relaxed or rest state of the rotary priming system of FIG. 1.
Figure 4:
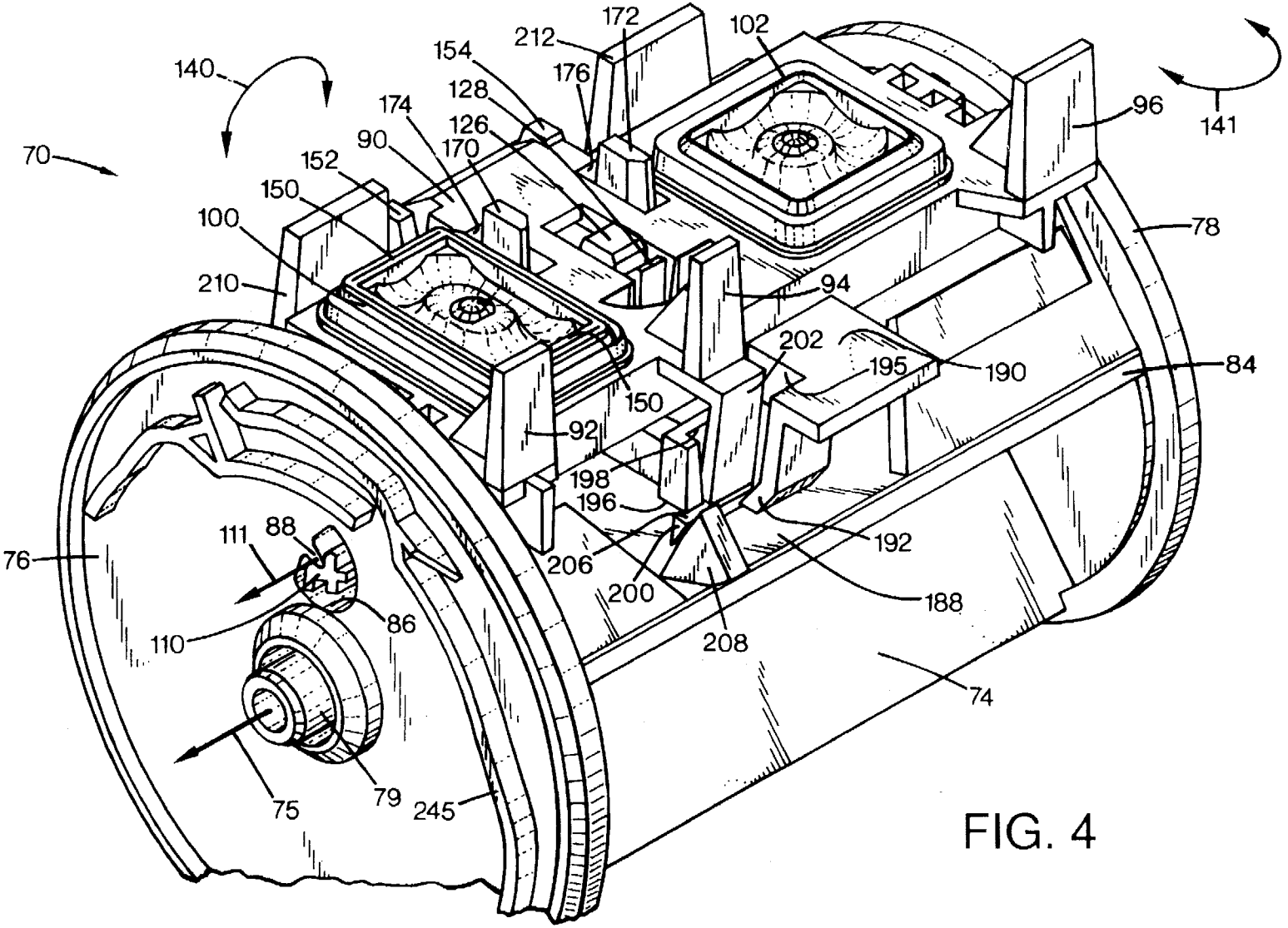
FIG. 4 is a partially fragmented perspective view showing a ready to prime condition of the rotary priming system of FIG. 1.

Referring to FIGS. 2–4, the service station 50 includes a printhead priming system 70 constructed in accordance with the present invention. Other components of the service station 50 include a frame 72 which may be slidably received by the printer chassis 22, although it is apparent that the service station 50 may also be constructed with the station frame 72 integrally formed within the chassis 22. A service station component carrier is mounted to the frame to selectively bring various printhead servicing components into servicing positions of contact with the printheads 60, 62. In the illustrated embodiment, the component carrier is a tumbler body portion 74, which is pivotally mounted to frame 72 for rotation about a first axis or tumbler axis 75, substantially parallel to the printhead scanning axis 57. The tumbler body 74 terminates at opposing axial ends with two wheel portions or rims 76 and 78. The tumbler body 74 may be mounted pivotally at hubs defined by the rims 76, 78, such as hub 79, to the service station frame 72, using conventional bushing assemblies.

The outer periphery of the tumbler rim 78 preferably has conventional gear teeth formed thereon to function as a drive gear, but for clarity, the gear teeth have been omitted from the figures. The tumbler 74 may be driven by a gear or belt assembly, driven by a motor (not shown) via gear teeth formed around the periphery of rim 78. The tumbler 74 may carry several other servicing components (not shown) for selectively servicing the printheads 64, 66 by rotating the components into a servicing position to engage the printheads. For instance, tumbler 74 may carry wipers for cleaning the printheads and caps for sealing the printheads during periods of printer inactivity. Located to one side of the tumbler 74, the station frame 72 defines a spittoon portion 80 for receiving ink droplets selectively purged or spit from the printheads 64, 66 to clear any partially clogged nozzles.

The rotary printhead priming system 70 includes the tumbler body 74, which has a rest wall 82 (FIG. 2), and a priming or stop wall 84 (FIG. 3). A rocker pivot post 85 extends upwardly from the stop wall 84. The tumbler rims 76 and 78 each define half-moon shaped recesses, such as recess 86 which also defines a rim pivot 88. The priming system 70 also has a primer platform or sled 90. To facilitate priming, the sled 90 has three extending alignment or contact horns 92, 94, 96, which may be configured to engage a printhead structure comprising portion of the pens 60, 62, or a portion the printhead carriage 52. As illustrated in FIG. 5B the horns 92, 94, 96 are located for cooperative adjacency to engage a printhead structure comprising a downwardly extending alignment member 98 of the carriage 52 during a selected portion of tumbler rotation.

The priming assembly 70 has black and color ink printhead sealing caps 100, 102, configured as rolling diaphragms, supported by sled 90 to form a seal with the printheads 64, 66 during priming. The caps 100, 102 may be joined to the sled 90 by any conventional manner, such as by bonding with adhesives, sonic welding, or more preferably by oncert molding techniques. In the illustrated embodiment, the caps 100, 102 may be of a non-abrasive resilient material, such as an elastomer or plastic, a nitrile rubber or other rubber-like material, but more preferably, caps 100, 102 are of an ethylene polypropylene diene monomer (EPDM), or other comparable material known to those skilled in the art. In the illustrated embodiment during priming, the black ink cap 100 seals the black pen 60, and the color cap 102 seals the color pen 62.

Figure 5A:
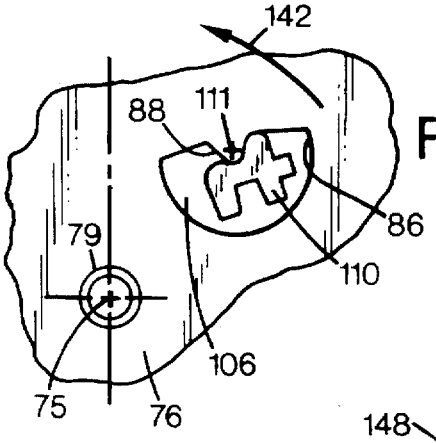
FIGS. 5A–5C and 6A–6C are enlarged sectional side elevational views showing the relative positions of portions of several components of the rotary priming system of FIG. 1, with FIGS. 5A–5C being views taken along the respective lines A—A, B—B, and C—C of FIG. 2 shown in the relaxed state, and FIGS. 6A–6C showing the ready to prime condition.
Figure 5B:
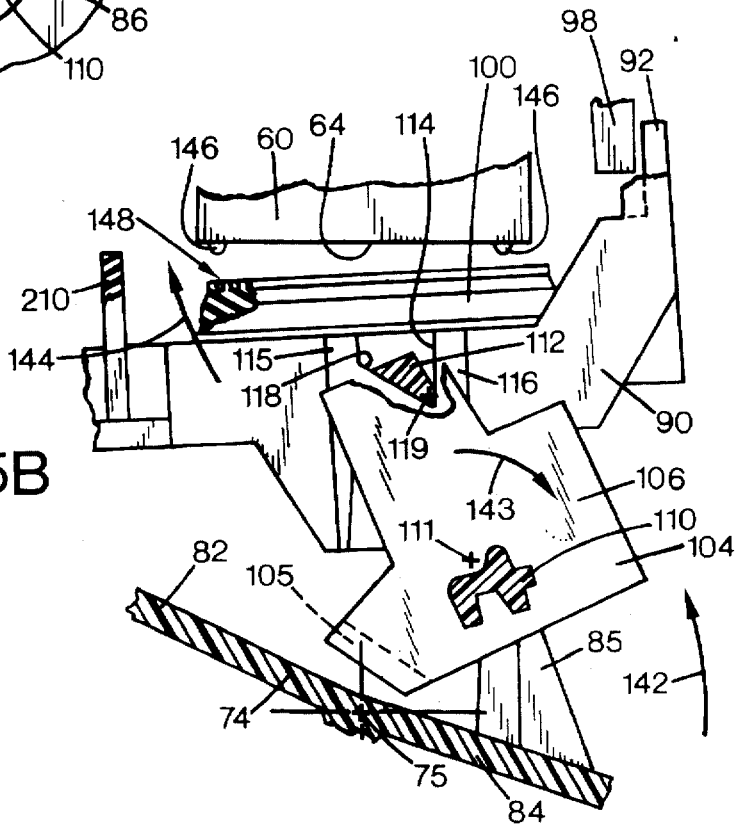
Figure 5C:
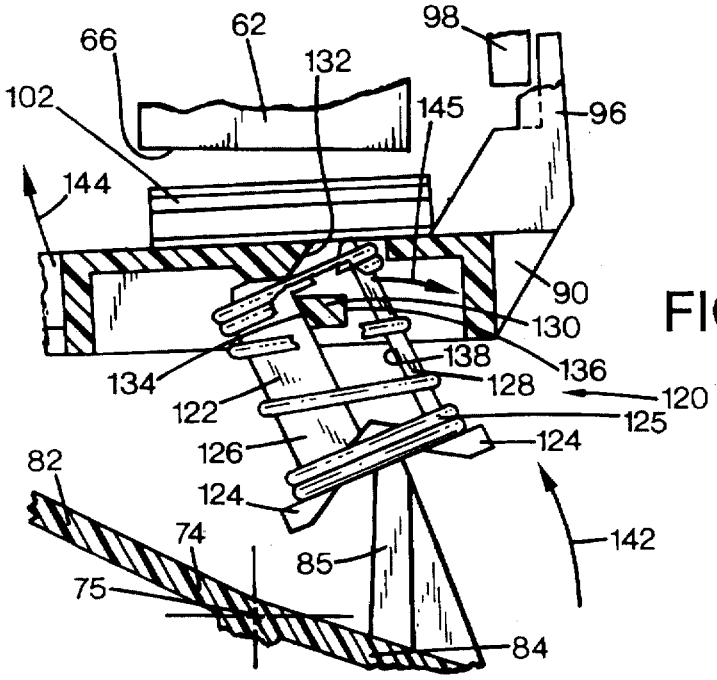
Figure 6A:
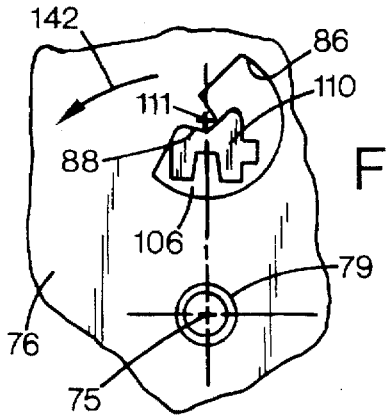
Figure 6B:
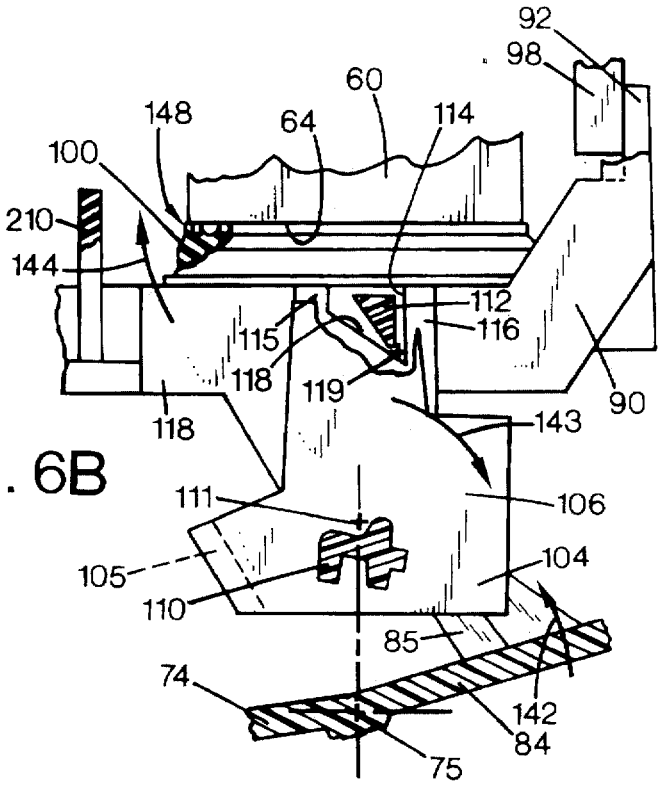
Figure 6C:
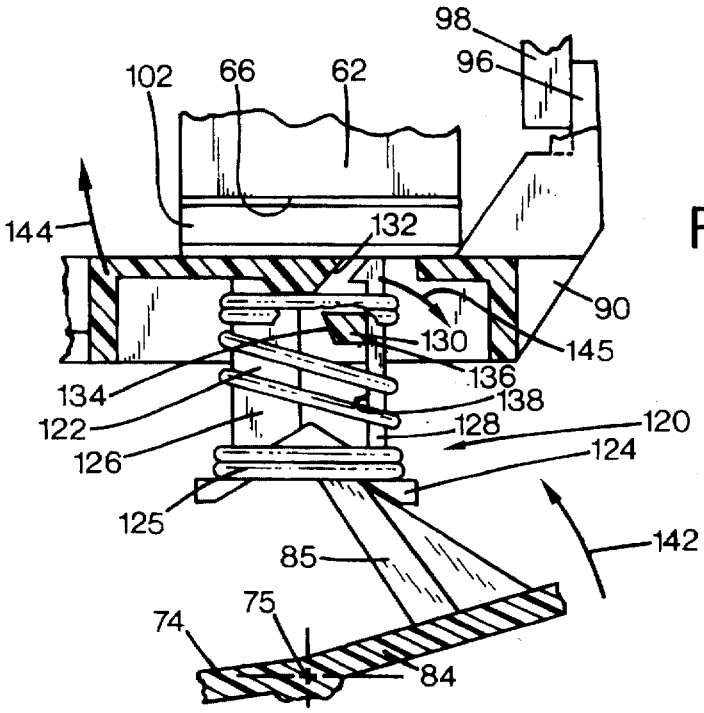

Referring also to FIGS. 5A through 8, one method of coupling the sled 90 to the tumbler body 74 is illustrated as using a link or yoke member 104 (for simplicity, the yoke 104 has been omitted from the views in FIGS. 5C and 6C). The yoke 104 is a dual pivot structure, having a bridge member 105 terminating in two upright ear members 106 and 108. Each ear 106, 108 has a lower rim pivot member which extends through the half-moon shaped slot defined by the tumbler rims 76, 78, such as rim pivot member 110 which extends through slot 86 in tumbler rim 76. The rim pivot members 110 engage and toggle about the pivot shoulders 88 during operation (compare FIG. 5A with FIG. 6A), for pivotal motion around a second axis 111, which is substantially parallel to the tumbler rotational axis 75. A comparison of FIGS. 5B and 6B shows the toggling action of the yoke 104 around axis 111 as the tumbler body 74 is rotated, while sled 90 is held by the engagement of horns 92, 94, 96 with the carriage locator 98. With respect to FIG. 5B, rotation of the sled 90 in a clockwise direction is limited by a projecting portion of ears 106, 108 which engages an under surface of sled 90.

The second portion of the dual pivot structure of yoke 104 is provided by two wedge-shaped pivot hooks along the upper inner surface of ears 92, 94, 96, such as pivot hook 112 on ear 106 (see FIGS. 5B and 6B). Each pivot hook 112 is captured by and received within a pocket 114 of sled 90. Each pocket 114 is defined by a pair of rails 115, 116 and a lower rest surface 118. As shown in FIG. 5B, the pivot hook 112 rests against the lower surface 118 when the priming assembly 70 is at rest. When in a priming position, the hook 112 rests against a loaded or priming pocket surface provided by the rail 116. Thus, the sled 90 pivots with respect to the yoke 104 around a third axis 119. As the yoke 104 toggles between the rest and priming positions, the pivoting action of yoke 104 with respect to the tumbler body 74 around axis 111 is controlled by the lower rim pivot 110, whereas the pivoting of the sled 90 with respect to yoke 104 around the sled axis 119 is provided by the wedge-shaped hooks 112.

As shown in FIGS. 5C and 6C, to bias the sled 90 in a rest position relative to the tumbler body 74, the priming assembly 70 also includes a biasing member 120 which urges sled 90 away from the tumbler body 74. To accomplish this, the biasing member 120 includes a rocking spring retainer or keeper member 122 with rocker arms 124, and a compression coil spring 125. The retainer rocker member 124 rests upon the rocker pivot post 85, which projects from the tumbler stop wall 84. During assembly and disassembly, the spring 125 is secured to the sled 90 by the keeper rocker arms 124.

The keeper 122 has two projecting finger members 126 and 128, which both terminate in latches that grasp a pivot pin or post member 130 of the sled 90. The sled pivot post 130 is recessed within a roughly T-shaped slot 132 formed within the cap-supporting platform portion of sled 90. The T-shaped slot 132 is sized to slidably receive therethrough the tips of the retainer fingers 126, 128. Preferably, the spring 125 is under a slight compression to bias sled 90 away from the tumbler stop wall 84, and toward the rest wall 82.

This biasing is also assisted by the relative lateral positioning of the post 130 and the yoke-to-sled pivot axis 119. Preferably, the post 130 is located within sled 90 to be centered (front to back) on the black cap 100, whereas the link pivot axis 119 is positioned slightly off-center toward horns 92, 94, 96 (such as about 2 mm off center in the illustrated embodiment).

To provide a greater upward sealing force of the cap 100 against the black pen face 64 than provided by the color cap 102 against the color pen face 66, the retainer 122 is mounted offset from the center line of the sled 90. That is, the T-shaped slot 132 and the pivot post 130 are mounted at a distance $D_1$ from the edge of the sled platform adjacent the black cap 100, and a distance $D_2$ from the opposite platform adjacent the color cap 102. For example, in the illustrated embodiment, the distance $D_1$ is approximately 23 mm, whereas $D_2$ is approximately 28 mm.

The spring 125 presses against the rocker arms 124 a lower surface of the sled 90, with the varying points of contact being shown in FIGS. 5C and 6C. In FIG. 5C, when at rest, the sled pivot post 130 has an angled bearing surface 134, which rests against the inner surface of keeper finger 126. In FIG. 14C, the sled pivot post 130 has an upright side 136, which rests against the inner surface of the other keeper finger 128. Note, that the first finger 126 is much wider than the second finger 128, which aids in biasing the sled 90 toward the rest position (FIG. 5C), while also providing substantially upright alignment for priming (FIG. 6C).

Moreover, the keeper fingers 126 and 128 form a slot 138 therebetween, which, in cooperation with the sled T-shaped slot 132, allow the sled 90 to further compress spring 125 through downward force of the printheads 60, 62. This stressing of spring 125 provides more secure sealing of the printhead nozzle plates 64, 66 during the priming process. That is, while the upper portions of fingers 126 and 128 are shown as being flush with the upper surface of sled 90 in FIG. 6C, the upper surfaces of fingers 126, 128 may extend above this surface due to compression of spring 125 if required for during the priming routine.

Figure 8:
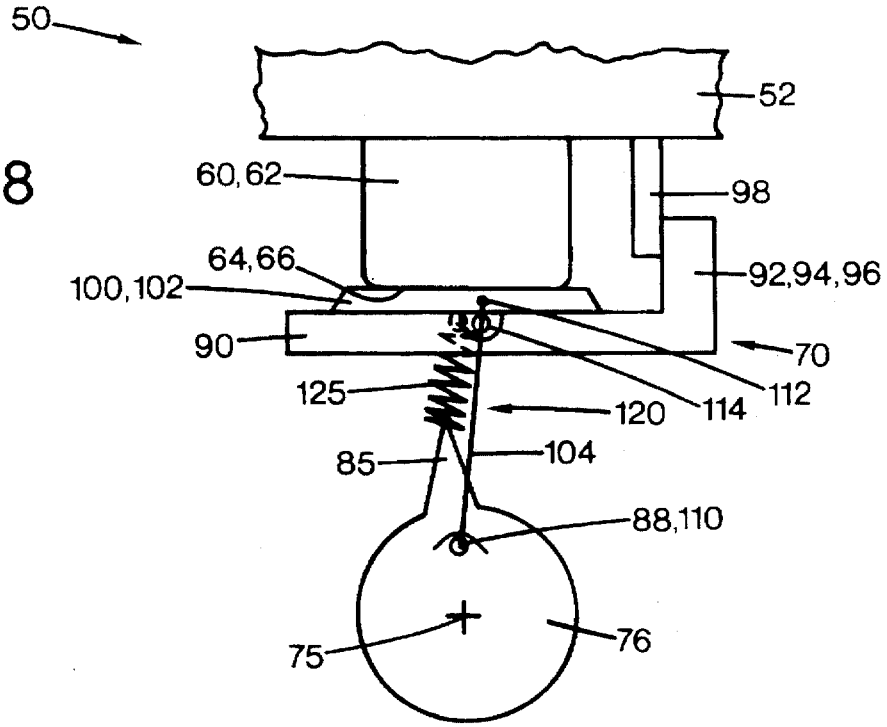

Note, that compression of spring 125 causes the wedge-shaped pivot hooks 112 (see FIGS. 5B and 6B) to float upwardly in the sled pockets 114, allowing the sled 90 to move with respect to the yoke 104, as also indicated schematically in FIG. 8. This floating of hooks 112 allows for tilting of the sled 90, as indicated by arrow 140 in FIG. 4. In this tilting motion, the hooks 112 may dip to different depths within the pockets 114 of yoke ears 106, 108, for example, to accommodate for any variations in the sealing forces required for the pens 60, 62. Furthermore, the hooks 112 are undersized with respect to the width of pockets 114, as defined by the spacing of rails 115, 116, which allows for some skewing of the sled 90 with respect to yoke 104, as indicated by arrow 141 in FIG. 4.

Figure 7:
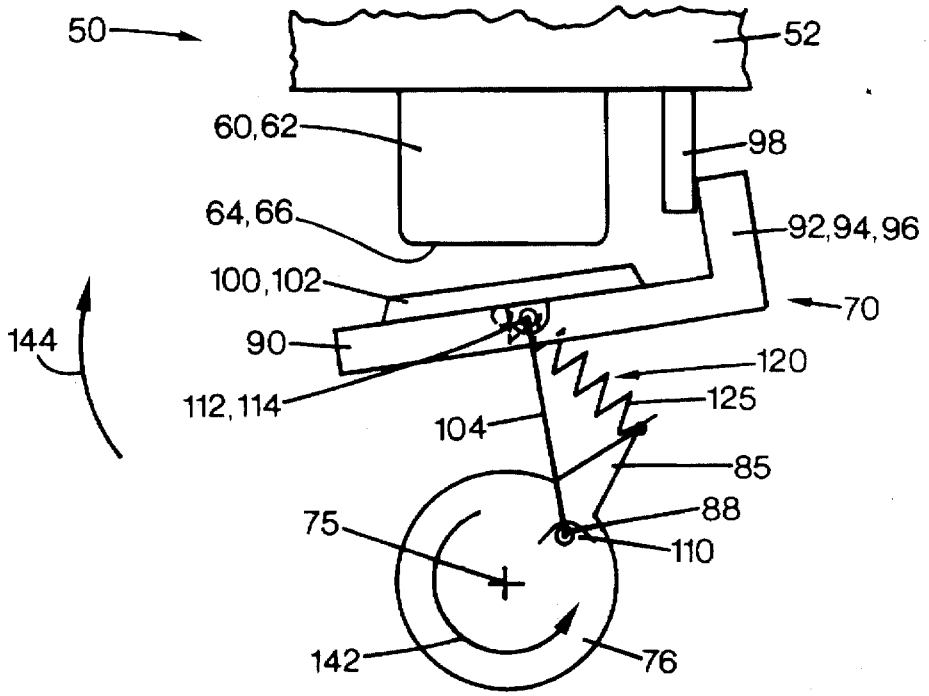
FIGS. 7 and 8 are schematic side elevational views illustrating the priming operation of the components in FIGS. 5A–5C and 6A–6C.

Before discussing the remaining components of priming system 70, the motion of the sled 90 with respect to the tumbler 74 is explained, with reference to the schematic drawings of FIGS. 7 and 8, to illustrate the relative forces and positions of the priming assembly 70 in the rest and priming positions. The printer 20 may include a conventional stepper motor, which is coupled to drive the tumbler about the first axis 75, via the drive gear teeth along the periphery of rim 78. The tumbler body 74 is rotated in the direction indicated by the curved arrow 142 until the carriage engagement horns 92, 94, 96 contact the carriage alignment member 98 (compare FIGS. 5B, 5C with FIGS. 6B, 6C).

Continued rotation of the tumbler body 74 in the direction indicated by arrow 142 causes the pivoting illustrated through a comparison of FIGS. 5A–5C with the respective FIGS. 6A–6C, as the priming assembly 70 transitions from a rest position to a priming position. FIGS. 5A and 6A illustrate the rotation of the yoke 104 with respect to the tumbler body 74. FIGS. 5B and 6B illustrate the rotation of the tumbler body 74, with respect to the yoke 104 and the sled 90. In FIG. 5B, while the tumbler body rotates in the direction indicated by arrow 142, the link 104 rotates around axis 111 in a direction indicated by arrow 143, and the sled 90 rotates upwardly around axis 119 in the direction indicated by the arrow 144 to rock into the priming position of FIG. 6B. FIG. 5C illustrates the rotation of the rocking spring keeper 122 with arrow 145.

When the horns 92, 94, 96 are no longer contacted by the printhead carriage member 98, the slight at-rest compression of spring 125 biases sled 90 away from the tumbler stop wall 214, which serves to retract the priming assembly 70 from the priming position back to the rest position. The noncentering feature of the keeper 122 also forces the sled 90 against the rest wall 82. Thus, this offcentering feature of the biasing member 120 forces the primer sled 90 into a rest position adjacent wall 82, allowing the priming assembly 70 to be rotated in the direction opposite arrow 142 without contacting the printheads 60, 62. This rest position or retracted state, allows the pens to freely travel over the service station 50 and over the printzone 25.

As shown in FIGS. 6B and 6C, the respective black and color pens 60, 62 are sealed by caps 100, 102 for priming, and the spring 125 is compressed. The compression force supplied by the rocker spring 125 upwardly from the tumbler stop wall 84 forces the sled 90 and the primer caps 100, 102 to press against the pen faces 64, 66 for a tight seal to enhance the priming efficiency. The gimbal mounting provided by the loose fit of the yoke wedge-shaped pivot hooks 112 within the sled pockets 114, as well as the gimbaling action provided by mounting sled 90 at retainer 122, allows the sled 90 to tilt with respect to a plane defined by the pen faces 64, 66. This tilting may compensate for irregularities on the printhead face, such as ink build up or elongated encapsulant beads 146 (FIG. 5B) at each end of the nozzle plate of the black pen printhead 64. These two beads 146 are of an encapsulant material, such as an epoxy or plastic material, which covers the connection between a conventional flex circuit and the printhead housing the ink firing chambers and nozzles.

To further aid in providing an air-tight priming seal, preferably the black cap 100 comprises a multi-ridge cap in accordance with the present invention for sealing the uneven printhead area at the encapsulant beads 146. To provide higher resolution hardcopy printed images, recent advances in printhead technology have focused on increasing the nozzle density, with levels now being on the order of 300 nozzles per printhead, aligned in two 150-nozzle linear arrays for the black pen 30. These increases in nozzle density, current limitations in printhead silicon size, pen-to-paper spacing considerations, and media handling constraints have all limited the amount of room remaining on the pen face for sealing. The end beads 146 also occupy a large portion of the overall printhead area.

To seal across the end beads 146, the black cap 100 preferably has two multi-ridged lip portions 148 comprising adjacent plural or redundant contact regions. Preferably, each redundant contact region is capable of sealing over surface irregularities on the face plate, including end beads 146, by forming an air-tight seal in the flat areas adjacent the irregularities. In the illustrated embodiment, each multi-ridged lip 148 comprises two or more substantially parallel ridges or crests, separated from one another by troughs or valley portions. The sealing ability of the multi-ridge lip 148 is shown in FIG. 6B sealing pen face 64 over end bead 146 by compressing at least one crest more than the other crest or crests are compressed. The lip 148 may also seal over ink residue or other debris accumulated on the pen face 64. While the adjacent plural contact regions are illustrated as mutually parallel ribs, it is apparent that other geometric patterns may also be used, such as interlinking ovals, circles, or a labyrinth pattern, for instance.

Figure 9:
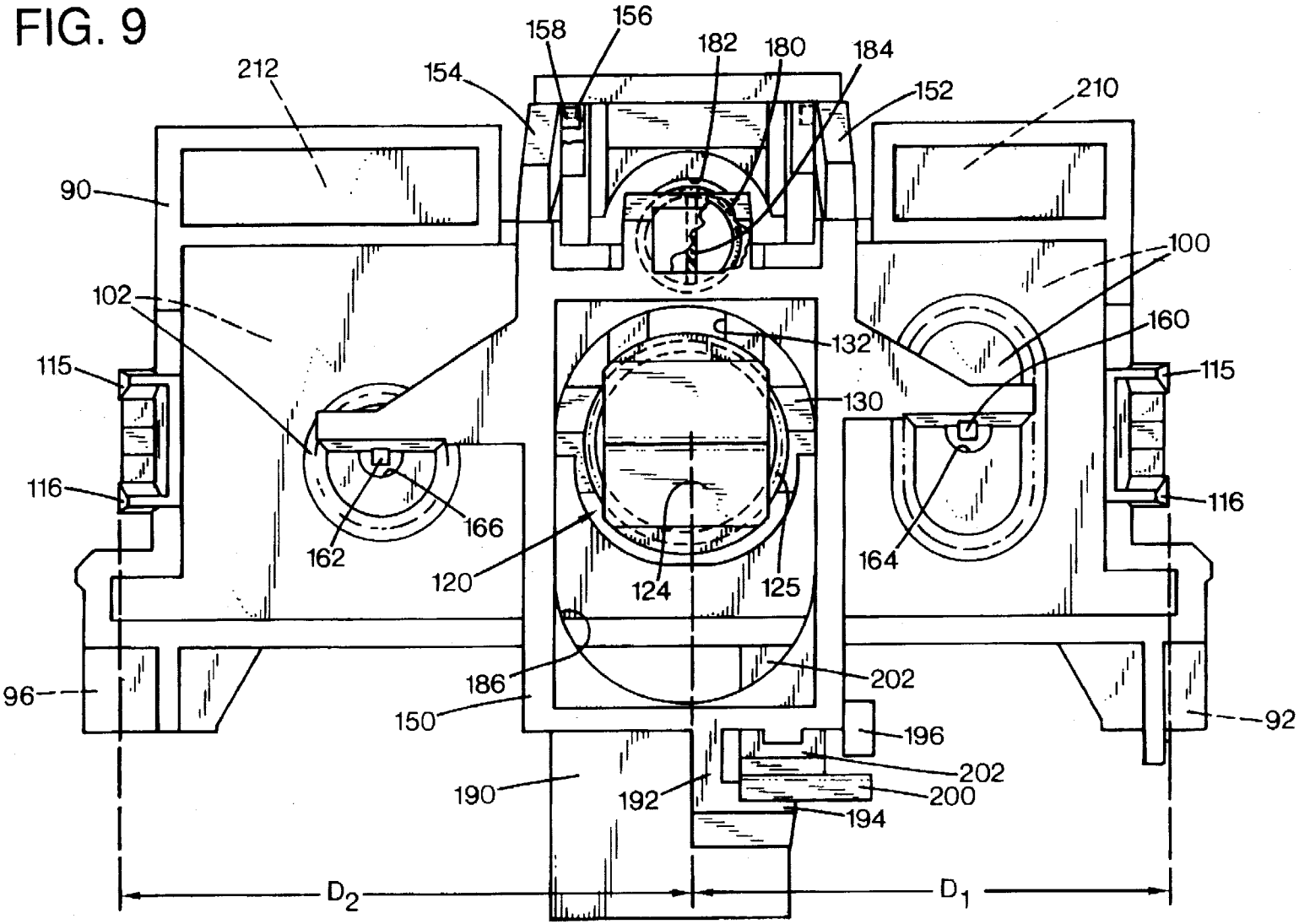
FIG. 9 is an enlarged bottom plan view of the primer sled and trigger mechanism of the rotary priming system of FIG. 1.
Figure 10:
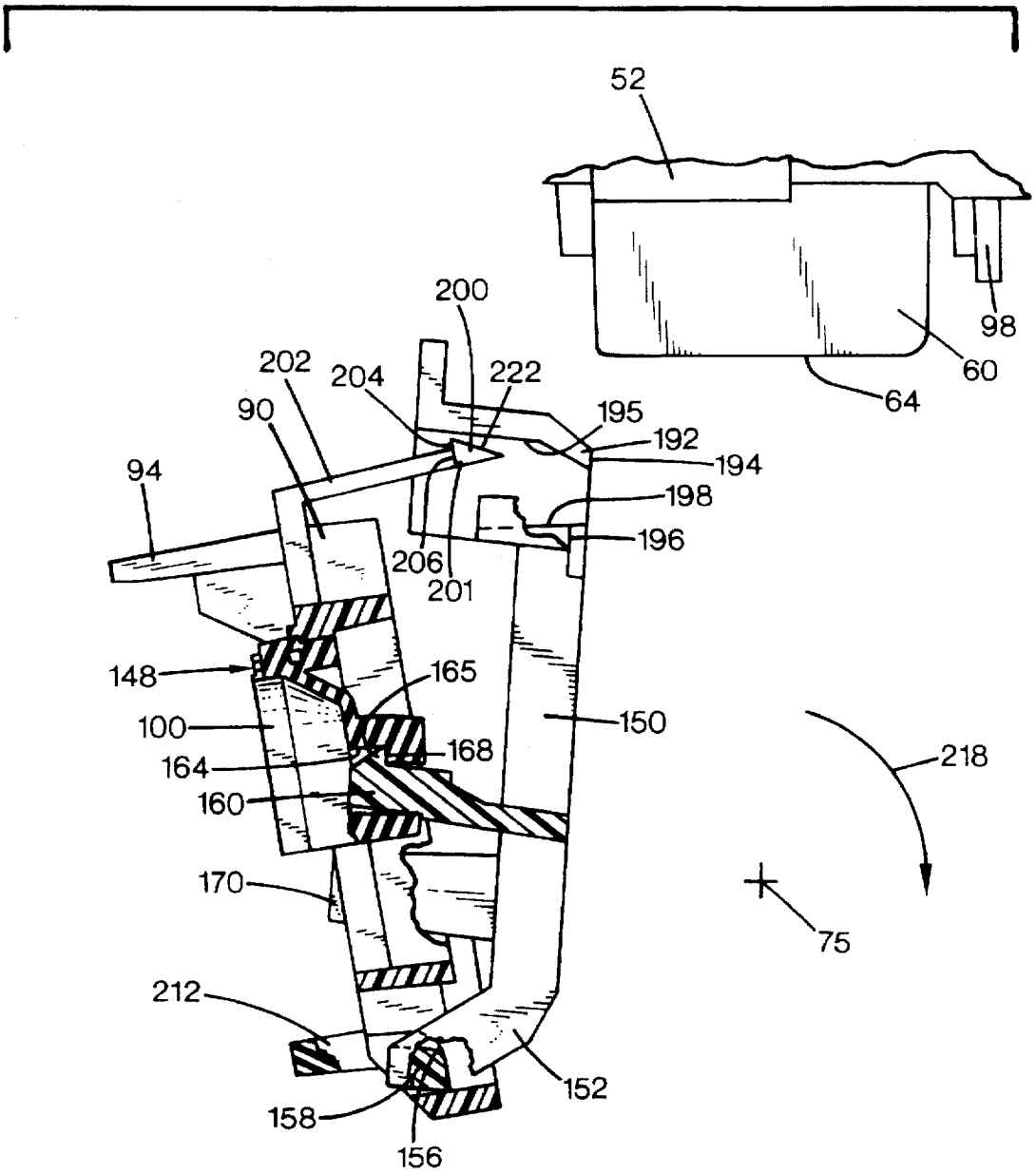

As shown in FIGS. 9 and 10, another major component of the rotary priming system 70 is a priming lever mechanism 150, which is pivotally attached to the sled 90, for example using arms 152, 154 of the priming lever. The sled 90 has two pockets 156 formed therein for pivotally receiving a pivot pin 158 extending from each priming lever arm 152, 154. Two priming plungers 160, 162 engage the respective black and color caps 100, 102, such as by extending through apertures 164, 166 defined by a lower surface of each cap 100, 102. Preferably, each priming plunger 160, 162 includes a hook 165, as shown in FIG. 10, which engages a projecting lip portion 168 defined by the caps 100, 102 within each of the plunger apertures 164, 166.

To prevent de-priming of the printheads 64, 66 when sealed by the priming caps 100, 102, the priming system 70 includes a pair of retractable stand-off members or fingers 170, 172. The stand-off fingers 170, 172 temporarily separate the printhead face plates away from the caps by contacting the face plates. The stand-off fingers 170, 172 project upwardly from the priming lever 150 to extend through a pair of apertures 174, 176, respectively, which are defined by sled 90.

To bias the priming lever 150 in a direction away from the sled 90, the priming system 70 includes a trigger spring 180. The trigger spring 180 extends between a pocket 182 formed on the underside of sled 90, and a spring guide 184 extending upwardly from the priming lever 150. The priming lever 150 includes a central aperture 186 through which the sled rocking spring retainer 122 and coil spring 125 extend to bias the sled 90 away from the tumbler 74.

The priming system 70 includes a trigger mechanism 188, which is formed by cooperation of the tumbler 74, the sled 90 and the priming lever 150. The triggering mechanism 188 serves to transition the priming system 70 from a relaxed condition as shown in FIG. 3, to a priming condition as shown in FIG. 4, and through a priming sequence or stroke, as illustrated in FIGS. 10–14. The trigger mechanism 188 includes a cocking lever 190 which extends from the priming lever 150. The priming lever 150 also has a sear portion 192, which has a lower surface which defines a fully cocked ledge 194. The sear 192 also defines a trigger travel chamber 195. Opposite the fully cocked ledge 194, the sear 192 has a lower surface which defines a half-cocked ledge 196. The sear 192 also defines a trigger relief channel 198 within the trigger travel chamber 195.

The trigger mechanism 188 also has a trigger 200, which includes a trigger head 201 located at a distal end of a trigger arm 202, which extends downwardly from the main body of sled 90. The trigger head 201 includes a fully cocked ledge portion 204 that engages the fully cocked sear ledge 194 to latch the trigger mechanism 188 in a pre-prime fully cocked position. Extending to the side the trigger arm 202, the trigger head 201 includes a half-cocked ledge portion 206, which engages the half-cocked ledge 196 of the sear 192 to latch the trigger mechanism 188 in an intermediate half-cocked position. In the half-cocked position, the trigger arm 202 is received within the trigger relief channel 198 of the priming lever 150.

The final component of the trigger mechanism 188 is the trigger finger 208, which projects upwardly from the tumbler priming wall 84. The trigger finger 208 is located along tumbler 74 to selectively engage the trigger head 201 upon rotation of tumbler 74 in the direction 142, as described further below.

The final components of the priming system 70 are black and color post-prime wiping members 210 and 212, which project upwardly from two ledge portions 214, 216 of the sled 90. The wipers 210, 212 wipe the respective printheads 64, 66 of pens 60, 62 after priming, as described further below. Preferably, the wipers 210, 212, as well as the priming caps 100, 102 are each of a resilient, non-abrasive, elastomeric material, such as nitrile rubber, ethylene polypropylene diene monomer (EPDM), or other comparable materials known in the art. While a variety of known attachment methods may be used, preferably, the wipers 210, 212 and the caps 100, 102 are onsert molded to the sled 90, such as by using conventional onsert molding techniques known to those skilled in the art.

Priming Method

In operation, the priming system 70 rapidly withdraws ink from the pen nozzles, wipes the nozzle face plate, and then cleans the primer cap and wiper through a blotting action to ready the system for a new priming cycle. First referring to FIGS. 10–14, the priming portion of the cycle will be described. When the printer controller 45 determines that priming is required, the printhead carriage 52 moves the pens 60, 62, the system enters an initial stage, shown in FIG. 10. For initialization of the cycle, the illustrated tumbler 74 is referred to as being at a 0° or free travel position, where the carriage 52 can travel freely over the service station 50.

Figure 11:
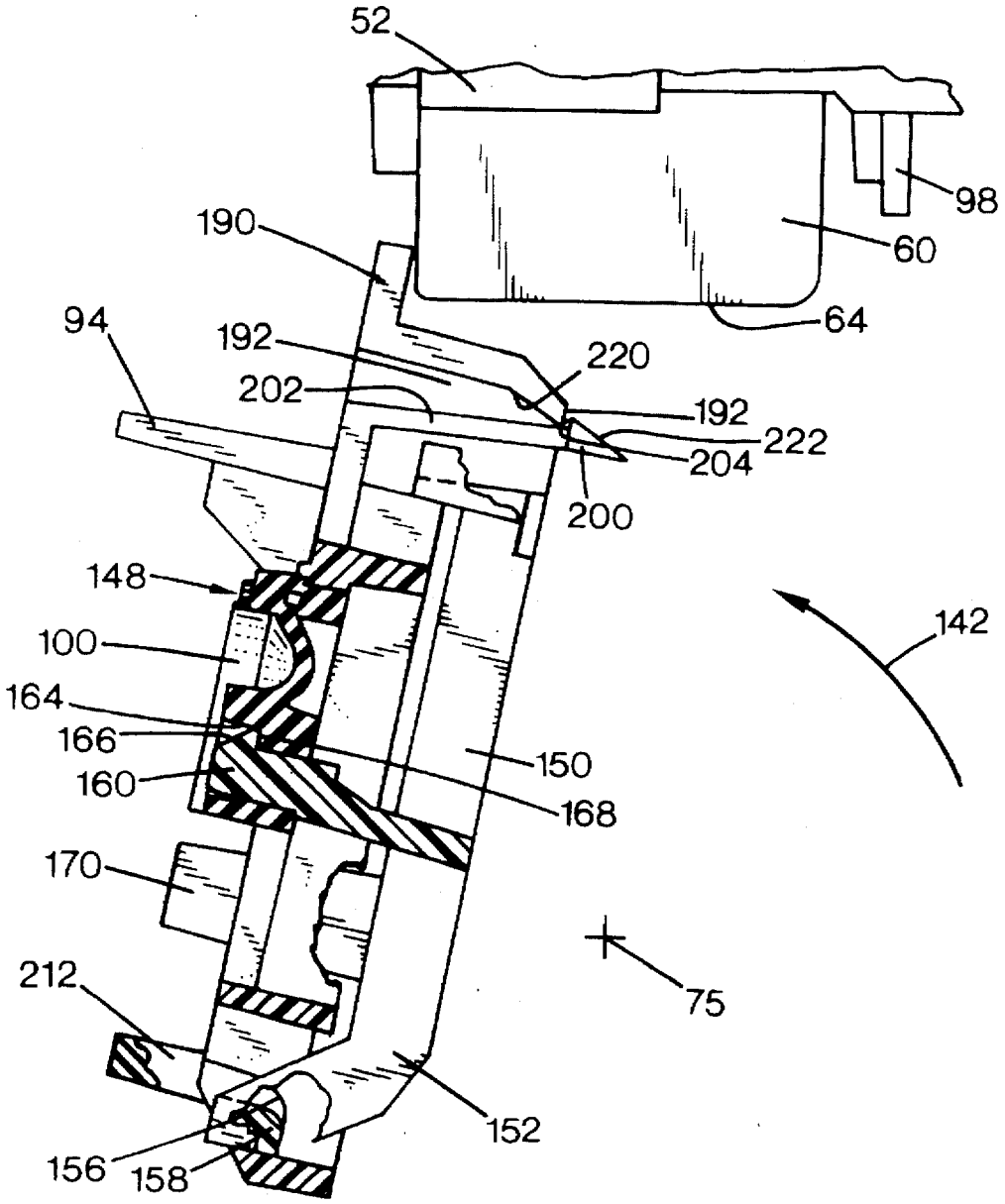

From the free travel position of FIG. 10, the tumbler 74 is rotated approximately 30° in the direction indicated by arrow 218, to cock lever 190 through contact with a printhead member, which may be either a portion of the carriage 52, or a portion of either the black or color pens 60, 62, as shown in FIG. 11. As the tumbler 74 rotates in direction 218, the priming lever 150 is held still, and the priming sled 190 is drawn through its pivotal attachment to the tumbler 74 into a fully-cocked state. During this cocking action, the trigger spring 180 is compressed as the pivot pins 158 rotate within pockets 156 at the ends of each of the pivot arms 152, 154. Rotation of the tumbler 74 continues in the direction indicated by arrow 218 until the trigger 200 has traveled through the sear chamber 195. The trigger arm 202 is biased through its own resilience outwardly from the main body of sled 90. Preferably the trigger head 201 is tapered to slide along a tapered portion 220 of the sear chamber 195 until the trigger ledge 204 is beneath the sear ledge 204 to latch the trigger mechanism 188 in the fully-cocked state. From the fully-cocked position of FIG. 11, the tumbler 74 rotates back in a direction indicated by arrow 142 to the free travel (0°) position of FIG. 10.

With the sled having returned to the free travel position of FIG. 10, the carriage 52 then moves pens 60, 62 back toward the print zone 25, which then allows the tumbler 74 to rotate approximately 96° in direction 218 into an enter-prime position. With the tumbler 74 in the enter-prime position, the carriage 52 moves the pens 60, 62 over the service station 50, and into a first stage pre-prime position as shown in FIGS. 5A–5C. The tumbler 74 then begins rotating in direction 142, and after approximately 44° of travel the tumbler is in a second stage pre-prime or a ready-to-prime position, as shown in FIGS. 6A–6C. At this stage of travel, the sled horns 92, 94, 96 engage the printhead carriage member 98 which causes pivoting of the link 84 with respect to tumbler 74, and pivoting of sled 90 with respect to the link 84, into the position shown in FIG. 12. In this pre-prime position of the priming stroke, the stand-off fingers 170, 172 prevent the printheads 64, 66 from engaging the sealing lips of caps 100, 102. The stand-off fingers 170, 172 advantageously delay sealing to prevent the primer caps 100, 102 from forcing air upwardly into the printhead nozzles, which would likely deprime or damage the pens by forcing air or ink clogs upwardly into the nozzle firing chambers.

In FIG. 12, the tumbler trigger finger 208 contacts the face 222 of the trigger head 201, ready to initiate the priming action. Without stopping, rotation of the tumbler 74 is continued approximately 3° further in direction 142, the trigger finger 208 moves the trigger 200 from the fully cocked position of FIG. 12, into a half-cocked position as shown in FIG. 4. In the half-cocked position, the trigger ledge 206 engages the sear ledge 196, and the trigger arm 202 flexes to be received within the relief channel 198 of the sear 192. There is a slight elevational difference between the fully cocked sear ledge 194 and the half-cocked sear ledge 196, which allows for a slight drop of the priming plungers 160, 162. The slight elevational difference between ledges 194 and 196 allows the trigger head 201 to travel the distance across the sear chamber 195 until the half-cocked ledges 196, 206 are able to engage, since during this transition between fully cocked and half-cocked positions, the compression forces supplied by the trigger spring 180 cause the priming lever 150 to move away from the sled 90.

In the half-cocked position of FIG. 4, the system momentarily pauses just long enough for the tumbler 74 to reverse its travel from direction 142 to direction 218. During this momentary pause at the half-cocked position, the tumbler 74 has been driven in direction 142 into a hard stop position. From this hard stop position, the duration of the priming stroke may be easily controlled by accurately controlling the initiation time. From a point of zero velocity at this hard stop, the tumbler 74 begins rotating in direction 218, which allows the tumbler to be fully up to speed when trigger 200, under its own spring force, moves off of the sear half-cock ledge 196, as shown in dashed lines in FIG. 12.

Upon leaving the half-cocked position, the trigger spring 180 then forces the priming lever 150 away from sled 90, as shown in FIG. 13. During this action, the stand-off fingers 170, 172 retract downwardly through sled 90, which allows the caps 100, 102 to fully engage and seal the face plates of printheads 64, 66. As the priming lever 150 moves downward in the direction indicated by arrow 224, the primer plungers 160, 162 pull the rolling diaphragms of caps 100, 102 downwardly. By delaying the sealing of the caps 100, 102 against printheads 64, 66 through synchronizing the downward travel of stand-off fingers 170, 172, the region within the chamber formed by the sealed caps and printheads is already attempting to establish a negative pressure at the time of sealing. The sealing delay introduced by the retraction time of the stand-off fingers 170, 172 advantageously prevents depriming of the pens because they are never subjected to a positive pressure during sealing. After sealing, the continued downward motion of the plungers 160, 162 draws a negative pressure on the printheads 64, 66, which draws primed ink 225 from the printhead nozzles. FIG. 13 shows the end of the prime stroke sequence.

Figure 14:
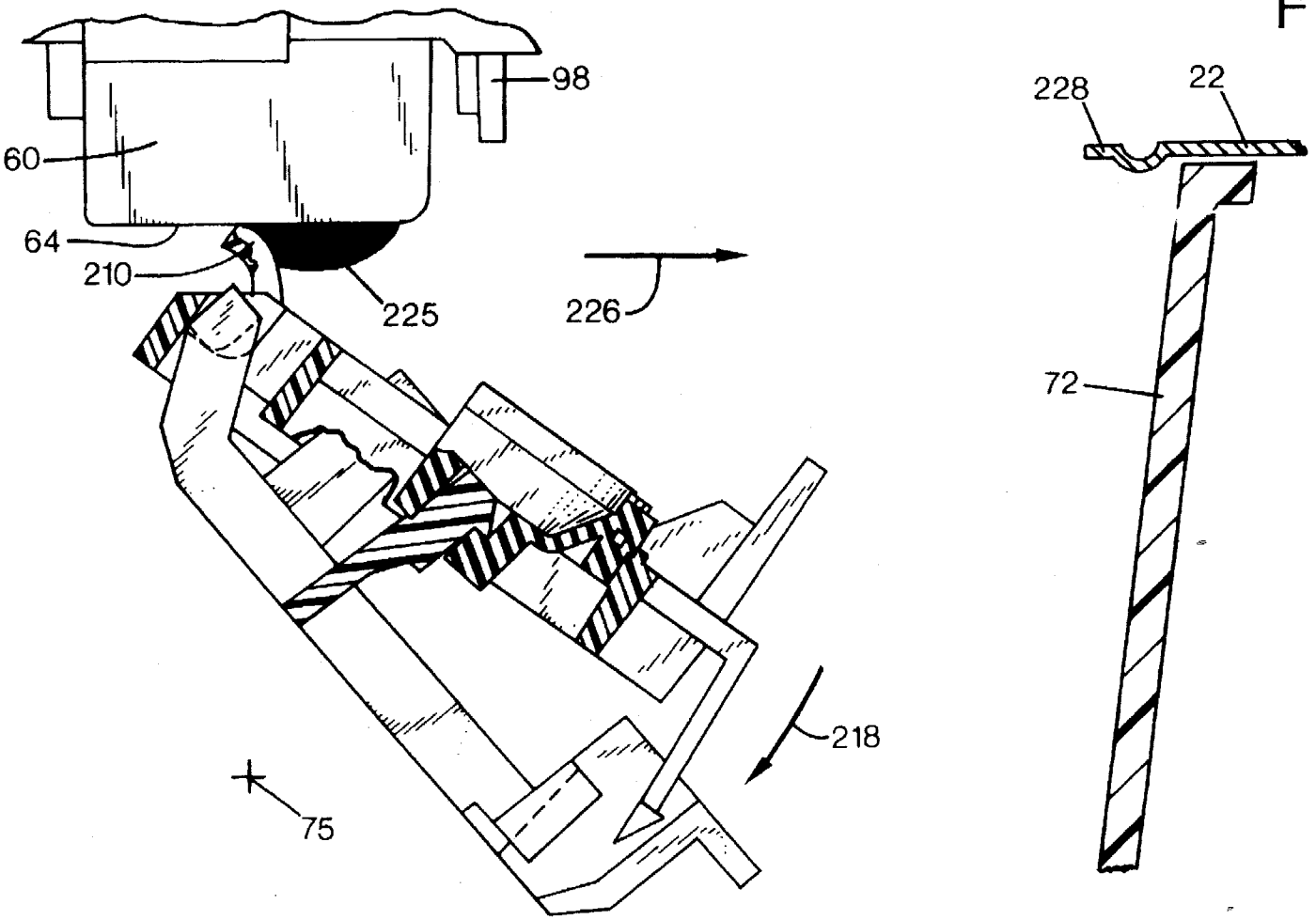

Immediately after completing the prime stroke, which is the transition between FIGS. 12 and 13, the tumbler 74 continues rotation in direction 218, which breaks the seal of caps 100, 102 against printheads 64, 66. Further rotation of the tumbler 74 in direction 218 approximately 110° brings the wipers 210, 212 into contact with the respective printheads 64, 66 to wipe the primed ink residue 225 from the printhead face plates. As shown in FIG. 14, the wiped ink residue 225 is flicked off the printhead, and then travels in the direction indicated by arrow 226.

To prevent the primed ink 225 from splashing outside of the service station frame 72, the printer chassis 22 is formed with a drop retaining lip or flicking guard member 228 which extends into an interior portion of the service station frame 72. In this manner, the primed ink is contained within the service station, where it may be absorbed by an absorbent layer 229 (see FIG. 2) which lines a bottom portion of the service station frame 72. The material of absorbent layer 229 may be of a felt, pressboard, sponge, foam, or other comparable materials known to those skilled in the art. Indeed, the liner 72 may extend under the other components of the service station 50, to absorb any ink leakage, and to provide a larger capillary path for liquids to travel before evaporating.

Preferably, the wiping step of FIG. 14 is accomplished immediately after the priming, on the order of a few milliseconds. This fast post-prime wipe prevents the primed ink 225 from being absorbed back into the pens 60, 62, since the pens are typically designed to store ink under a negative pressure to prevent drooling of ink from the nozzles. Thus, this fast post-prime wipe removes the purged ink from the pen face plates to prevent re-absorption of debris and to ready them for printing or another priming cycle.

Blotting System

Figure 15:
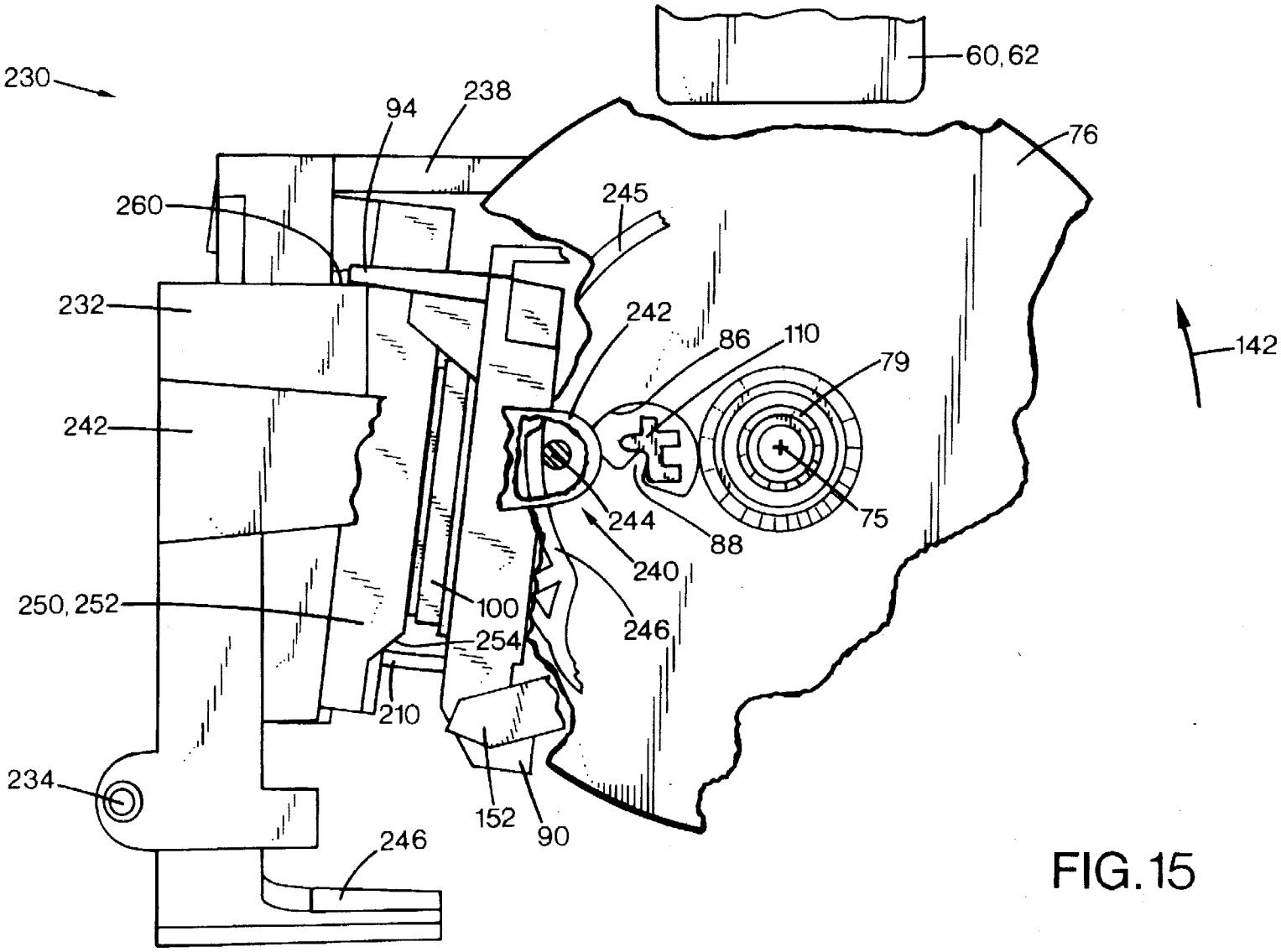
FIG. 15 is a side elevational view of the rotary priming system of FIG. 1 taken along the line A—A of FIG. 2, but removed from the service station frame to show one form of a primer blotting portion of the present invention.

Referring to FIG. 15, the illustrated priming system 70 includes an optional cap and wiper blotting system 230 constructed in accordance with the present invention. The blotting system 230 operates to absorb at least a portion of any primed ink from the surfaces of caps 100, 102 and wipers 210, 212. The blotting system 230 has a frame portion 232 which is preferably pivotally mounted within the service station frame 72, for example at pivot point 234 in FIG. 2. Attached to the blotting frame 232 are black and color scraper arms 236, 238 which may be used to scrape a set of main printhead wipers (not shown) which are preferably mounted along another portion of the tumbler 74.

Preferably, the tumbler 74 rotates freely without the blotting system 230 interfering with various other printhead servicing components, such as sealing caps (not shown) mounted on the tumbler. To facilitate this free travel, while still blotting the caps 100, 102 and wipers 210, 212, the blotting system 230 includes a cam system 240. The camming system 240 controls the pivotal motion of the blotting system 230 with respect to the service station frame 72. The cam system 240 includes a cam arm 242 that extends from the scraper frame 232, and has a cam follower 244 that engages a cam surface 245 formed along the outer surface of the tumbler rim 76.

FIG. 15 shows the position of the tumbler 74 for blotting the caps 100, 102 and wipers 210, 212. The blotter frame 232 includes a cantilever spring or biasing arm 246, which rides along an end portion of a biasing post 248 extending upwardly from a bottom wall of the service station frame 72. The cantilever spring arm 246 pushes against the biasing post 248 to move the blotter frame 232 away from the tumbler 74. The spring arm 246 has resilient properties allowing it to compress slightly in response to the camming action provided by cam system 240 for effective blotting in response to rotation of the tumbler body 202.

For simplicity, FIG. 15 illustrates operation of the rotary station 50 in blotting only the black cap 100 and the black ink wiper 210, although it is apparent that the color cap 102 and wiper 212 are simultaneously blotted in the same fashion. During the priming stroke, the cam follower 244 is free of the cam surface 245. After priming, the tumbler 74 is rotated in direction 142 into the position in FIG. 15, with the cam structure 245 including a blotting cam portion 246 engaged by the cam follower 244.

Housed in the blotter frame 232 under the scraper arms 234, 236 are a pair of blotter pads 250, 252 for blotting the respective black and color caps 100 and 102. Preferably the blotter pads 250, 252 each include a contoured or beveled area 254 which defines a receptacle for receiving the post prime wipers 210, 212. This beveled areas 254 contacts a leading wiping edge of the wipers 210, 212 to advantageously blot ink from the wiping side of the wipers that engages the primed ink 225 (FIG. 14).

Preferably, the blotter pads 250, 252 are of a material that absorbs the liquid ink residue and assists in promoting the capillary draw of the ink through the pads. The pads 250, 252 may be of any type of liquid absorbent material, such as of a felt, pressboard, sponge or other material. Preferably, the blotting pads 250, 252 are of a material that pulls up an average of 1.5–2.0 grams, or even more preferably about 1.7 grams of ink per 10 seconds for a pigment based ink, within a volume that fits into the scraper frame 232. More preferably, the blotting pads 250, 252 are of a polyolefin material, such as a polyurethane or polyethylene sintered plastic, which is a porous material, and more preferably that manufactured by the Porex company of Atlanta, Ga. Alternatively, the blotting pads 250, 252 may be of a cellulose acetate material, such as an extruded acetate fiber bundle, similar to a cigarette filter, such as that made by American Filtrona of Richmond, Va.

Preferably, the exterior blotting surfaces of the blotter pads 250, 252 are treated with surfactants, such as fluorosurfactants. These surfactants aid in drawing the ink deep into the pads 250, 252 through capillary action by increasing adhesion of ink into the surfaces of the pads. Preferably, the surfactant imparts an electrical charge to the blotter pad fibers, which is opposite to an electrical charge on the ink particles. In this manner, the blotter pads serve to electrostaticly draw the ink from the caps 100, 102 and wiper 210, 212 as well as attracting the ink droplets through capillary action and mechanical contact.

Blotting Method

A blotting portion of the priming cycle is then initiated after the wiping step of FIG. 14. First, with the tumbler positioned at approximately 157° for an end of wipe position, the carriage 52 and pens 60, 62 are moved toward the print zone 25. With the pens 60, 62 clear of the service station 50, tumbler 74 then rotated in direction 142 approximately 201° until the caps 100, 102 contact the blotter pads 250, 252.

As shown in FIG. 15, the primer caps 100, 102, as well as wipers 210, 212 are blotted against the blotter pads 250, 252, with the wiper conveniently contacting a shallower portion of the blotter pads adjacent the beveled area 254. Thus, first the primer caps 100, 102 are blotted in a de-cocked position. To remove ink from the interior of the caps 100, 102, the carriage 52 then moves back over the service station 50 to cock the priming mechanism as shown in FIG. 11, as tumbler 74 rotates in direction 218. The carriage 52 is then transitioned out of the service station area toward the print zone 25. The tumbler 74 then rotates in direction 142 to blot the now fully-cocked caps 100, 110 against the blotter pads 250, 252. It is apparent that this blotting scheme may be modified in a variety of different ways without departing from the principles of the claimed invention. For instance, the caps could be first blotted in the fully cocked position, then returned to the priming position for another priming stroke.

To assist in the blotting action, through tumbler rotation in direction 142 the blotter frame 232 is drawn toward the tumbler 74 as the blotter cam follower 244 moves along portion 246 of the rim cam surface 245. To prepare the priming system 70 for the next priming cycle, during this final blotting step the trigger finger 208 advantageously engages the trigger 200, to transition the trigger mechanism from the fully-cocked to the half-cocked state. As the tumbler 74 reverses direction, traveling in direction 218 the trigger 200 is released from the half-cocked state to allow the priming system 70 to return to the rest position of FIG. 3.

When blotting, the tumbler 74 is driven to a hard stop position, established by the sled horn 94 engaging a stop ledge portion 260 of the blotting frame 232. Preferably, the stop ledge 260 is located between the scraper arms 236, 238. To show the engagement of sled horn 94 with the stop ledge 260, the black scraper arm 236 has been removed from the view in FIG. 15.

When blotting in an uncocked position, the wedge shaped trigger head 201 is advantageously sandwiched between an angular portion of the trigger finger 208, and a flat surface 262 (see FIG. 13) of the priming lever sear 192. This method of obtaining a hard stop position for the tumbler 74 advantageously provides additional feedback to the controller 45, as to the rotational position of the tumbler 74. Thus, there is no need for extraneous optic or mechanical sensors to provide tumbler positional information to the controller 45. Moreover, the system allows for a coarse tolerance on the angle of rotation of the tumbler 74.

Conclusion

Several advantages are realized using the rotary priming system 70 as illustrated herein. For instance, the stand-off fingers 170, 172 prevent the prime caps 100, 102 from sealing until the priming plungers 160, 162 are moving downwardly to create a negative pressure within the priming cap chambers. In this manner, the printheads 64, 66 are protected from positive pressure spikes, which may otherwise deprime and ruin the pens 60, 62. Thus, pen life is prolonged.

The diaphragm caps 100, 102 used in combination with the priming lever plungers 160, 162 provides a priming system, capable of generating high priming pressures. For example, the illustrated priming system 70 generates priming pressures on the order of 24 KPa (kilo-pascals) (3.5 pounds per square inch). It is apparent that other priming pressures may be easily obtained, for instance by varying the internal volume of the priming caps 100, 102, or by varying the force of the trigger spring 180. Other priming pressures may also be obtained by varying the ratio of the system displaced volume to the total system dead space volume, that is the volume defined by the caps 100, 102 when sealed against the printheads 64, 66 before prime to that after the plungers pull the rolling diaphragms down. Moreover, this diaphragm cap and plunger priming system is constructed of simple economical parts which are easily manufactured and assembled.

As another advantage, the priming system 70 coordinates both pen and carriage motion, in combination with rotary motion of the service station tumbler 74 to activate the trigger mechanism 188. This provides for a very cost effective, economical implementation of the priming system 70, using the capabilities of existing printer components for activation.

A further advantage is the ruggedness of the priming and blotting mechanisms. The gimbaling action of sled 90, provided by the loose fitting alignment of the yoke 104 and sled 90, as well as that provided by the rocker 85 that couples the sled 90 with the tumbler body 74, allows for gimbaling or tilting action of the sled 90 with respect to the tumbler body 74. Moreover, the loose fitting nature of these pivots renders them virtually immune to any ink contamination from pen leakage, which would otherwise bind the service station and prevent operation in a tight fitting service station system. This immunity to ink contamination is particularly important with respect to the newer pigment-based inks, which may increase friction on the sliding surfaces of various subsystems within the printer, a problem avoided by the rotary service station 50. Another advantage of the priming system 70 is the ability to securely cap the black printhead 60, including providing capping along the end cap beads of protective sealant 146, through the use of the multi-ridged sealing lips 148 of the black cap 100.

Another distinct advantage of the gimbal mounted sled 90 is its adaptability to other mounting systems, other than the tumbler 74. For instance, the sled 90, carrying the primer caps 100, 102 may be mounted on a translating carrier, rather than on a rotary carrier, here, shown as tumbler 74. Such a translating or carrier may be worm gear driven, for example, to move from front to back in the printer enclosure 24. During this translational motion, contact of the horns 92, 94, 96 with a portion of the printheads or carriage rocks the sled 90 upward into contact with the face plates for priming. The blotting mechanism 230 may be pivotally or translationally mounted above the sled and carrier, and through a cammed coupling with the sides of the carrier, pulled down to blot the primer caps 100, 102. It is apparent that such a translational carrier may also support other printhead servicing components, such as elastomeric wipers, which may be constructed as described above for the primer wipers 210 and 212. It is also apparent that such a translational carrier may support another sled of the same basic construction as sled 90, but without the trigger mechanism 188 and stand-off members 170, 172. This second sled may be used to carry caps for humidically sealing the printheads during periods of printer inactivity. Such sealing caps may be constructed as described above for caps 100, 102, but without the apertures 164, 166 for the plungers 160, 162. Instead, these apertures may be configured in a variety of different ways known to those skilled in the art for pressure relief purposes to prevent depriming of the pens during capping. Contact of sled horns on this second capping sled with either the printheads or carriage raises the caps into contact with the face plates for sealing.

The unique two stage triggering mechanism 188, having fully cocked and half-cocked positions, delays the start of the priming stroke until the tumbler 74 is moving in the proper direction for priming and for a subsequent post prime wipe. This priming system advantageously allows for very short prime times, on the order of 100 milliseconds or less. This short priming time is then immediately followed by the post prime wiping sequence (FIG. 14), which can occur within a few milliseconds of the priming stroke. It is apparent that the duration of the priming stroke can be lengthened by adjusting the tumbler velocity profiles programmed for instance, within the firmware of the printer controller 45.

Several advantages are also realized in using the blotting system 230. The blotter pads 250, 252 advantageously collect ink residue first from the sealing lip portions of the priming caps 100, 102. Then after cocking, the pads 250, 252 extract ink from the interior regions of the caps. The beveled portion 254 of the blotter pad advantageously cleans the wiping surface of the post prime wipers 210, 212. Thus, the priming system 70 is cleaned and ready for contact with the printheads 64, 66 during the next priming operation.

We claim:

1. A service station for servicing inkjet printheads of an inkjet printing system, comprising:

a printing mechanism including an inkjet printhead having a face plate with nozzles extending therethrough that selectively eject ink;

a frame;

a platform moveably supported by said frame to a priming position while the printhead is held in a servicing position;

a diaphragm supported by the platform to seal the face plate at said priming position; and a trigger mechanism pivotally attached to the platform and being coupled to the diaphragm, with said trigger mechanism being operably to move the diaphragm down to cause a negative priming pressure on the nozzles when sealed against the face plate at said priming position.

2. A service station according to claim 1 further including a blotting mechanism pivotally attached to the frame and being engaged with the diaphragm to absorb at least a portion of any primed ink from a surface of the diaphragm.

3. A service station according to claim 1 wherein the trigger mechanism includes a stand-off mechanism operable to separate the diaphragm from the face plate until the diaphragm begins to move to cause said negative priming pressure.

4. A service station according to claim 1, further including a biasing member that urges the trigger mechanism away from the platform to draw said negative priming pressure.

5. A service station according to claim 3 wherein:

the platform includes a stand-off aperture; and the stand-off mechanism extends through the platform stand-off aperture.

6. A service station according to claim 1 wherein the trigger mechanism comprises a dual stage trigger.

7. A service station according to claim 1 wherein the trigger mechanism has a lever pivoted to the platform, and a trigger spring that biases the lever away from the platform, with the trigger spring moving the lever through a priming stroke to prime the printhead.

8. A service station according to claim 1 wherein:

the platform is moveable to a wiping position; and said platform further includes a wiper supported thereon to wipe the face plate when said platform is moved into the wiping position.

9. A service station according to claim 8 further including a blotting mechanism engageable with the diaphragm and the wiper to absorb ink primed from said printhead.

10. A service station according to claim 1 wherein the trigger mechanism includes a cocking lever being operated through engagement of the platform with the printhead when held in the servicing position to move the trigger mechanism into a cocked position.

11. A service station according to claim 10 further includes:

a tumbler rotatably supported by the frame for rotation around a first axis, with the tumbler having a trigger finger;

the platform is pivotally attached to the tumbler for movement to the priming position; and the trigger mechanism includes a trigger responsive to contact by the tumbler trigger finger to move the trigger mechanism from the cocked position to prime the printhead.

12. A service station according to claim 11 wherein:

the trigger mechanism includes a sear having a fully cocked portion for holding the trigger in the cocked position, with the sear also having a half-cocked portion for holding the trigger in a half-cocked position;

the tumbler is rotated in a first direction and in a second direction opposite to said first direction; and the trigger finger moves the trigger from the cocked position to the half-cocked position when the tumbler is rotated in the first direction, and when the tumbler is rotated in the second direction, the trigger is released from the half-cocked position to prime the printhead.

13. A service station according to claim 1 wherein the trigger mechanism further includes a plunger that engages the diaphragm to move the diaphragm through a priming stroke from a pre-prime cocked position to a post-prime relaxed position.

14. A service station according to claim 13 wherein:

the trigger mechanism has a lever pivoted to the platform;

the diaphragm defines a plunger aperture; and the plunger extends from the lever to engage the diaphragm plunger aperture for movement through the priming stroke.

15. A service station according to claim 1 wherein:

the service station further includes a tumbler rotatable around a first axis; and the platform is pivoted to the tumbler for movement to the priming position.

16. A service station according to claim 15 further includes:

the tumbler is rotatably supported by the frame for rotation to a blotting position; and pivotally attached to said frame, a blotting mechanism responsive to tumbler rotation into the blotting position to engage the diaphragm to absorb at least a portion of any primed ink from a surface of the diaphragm.

17. A service station according to claim 16 wherein:

the trigger mechanism further includes a plunger extending from the lever to engage the diaphragm plunger aperture to move the diaphragm through a priming stroke from a pre-prime cocked position to a post-prime relaxed position; and the blotting mechanism blots the diaphragm when in the pre-prime cocked position and when in the post-prime relaxed position.

18. A service station according to claim 16 wherein:

the platform is moveable to a wiping position;

the service station further includes a wiper supported by the platform to wipe the face plate when moved into the wiping position; and the blotting mechanism engages with the wiper to absorb primed ink therefrom.

19. A service station according to claim 16:

the tumbler has a rim portion with a cam structure; and the blotting mechanism has a blotting pad and a cam follower that engages the tumbler cam structure as the tumbler is rotated into the blotting position to bring the blotting pad into contact with the diaphragm.

20. A service station according to claim 15 wherein:

the printhead traverses along a scanning axis adjacent a printzone where ink is selectively ejected through the printhead nozzles; and the first axis is substantially parallel to the scanning axis.

21. A service station according to claim 15 further including a link that couples the platform to the tumbler.

22. A service station according to claim 21 wherein the link comprises a dual pivot structure having a tumbler pivot structure that pivots the link to the tumbler, and a platform pivot structure that pivots the link to the platform.

23. A service station according to claim 22 wherein:

the platform has an arm portion that engages a printhead structure when the tumbler is rotated around the first axis;

the link pivots to elevate the platform to the priming position when the platform arm portion engages the printhead structure; and the service station further includes a biasing member that urges the platform away from the tumbler so the biasing member is stressed when the platform is elevated to the priming position.

24. A service station according to claim 15 further including a biasing member that urges the platform away from the tumbler.

25. A service station according to claim 24 wherein:

the printing mechanism further includes an additional printhead having nozzles;

an additional diaphragm is supported by the platform to surround and seal the additional printhead nozzles at the priming position; and the biasing member engages the platform between said diaphragm and said additional diaphragm at an off-center location of the platform.

26. A service station according to claim 24 wherein:

the tumbler has a rocker post;

the biasing member comprises (1) a rocker member that pivots around the tumbler rocker post and rocks between a rest position and the priming position, the biasing member also having (2) a spring member surrounding the rocker member to urge the platform away from the tumbler;

the platform has a recess with a post extending across the recess; and the rocker member has two latching fingers which grip the post in the rest position, the latching fingers defining a slot therebetween within which the post floats when the spring member is compressed in the priming position.

27. A service station according to claim 1 wherein:

the diaphragm defines a plunger aperture; and the trigger mechanism includes:

a lever member;

a plunger extending from the lever member to engage the diaphragm plunger aperture to move the diaphragm through a priming stroke from a pre-prime cocked position to a post-prime relaxed position; and a stand-off mechanism extending from the lever member to engage the face plate and separate the diaphragm from the face plate until the diaphragm begins the priming stroke.

28. A service station according to claim 1 wherein the diaphragm has a sealing lip with at least a portion of the lip having at least two mutually parallel ridge portions separated by a trough portion.

29. A service station according to claim 1 further including:

a tumbler rotatably supported by the frame for rotation around an axis, with the platform pivoted to the tumbler by a link for movement to the priming position;

pivotally attached to the platform and being operably a stand-off mechanism to engage the face plate and separate the diaphragm from the face plate until the diaphragm begins to move to draw said negative priming pressure;

a wiper supported by the platform to wipe the face plate when moved into a wiping position; and pivotally attached to the platform and being engageably a blotting mechanism with the diaphragm to absorb at least a portion of any primed ink from a surface of the diaphragm.

30. A method of priming an inkjet printhead of an inkjet printing mechanism, the printhead having a face plate with nozzles extending therethrough that selectively eject ink, comprising the steps of:

providing a trigger mechanism which is coupled to a diaphragm;

cocking a trigger mechanism to place said diaphragm configured to surround the nozzles and seal the face plate into a cocked pre-prime position;

moving the diaphragm into a priming position through engagement with said printhead while holding the printhead in a servicing position; and releasing said trigger mechanism to induce diaphragm movement that causes a negative priming pressure on the nozzles when the diaphragm is in the priming position.

31. A method according to claim 30, wherein the releasing step includes the steps of moving the trigger mechanism from the cocked pre-prime position to a half-cocked position, followed by moving the trigger mechanism to a released position to induce said diaphragm movement.

32. A method according to claim 31, wherein:

the moving step comprises the steps of supporting the diaphragm with a tumbler, and rotating the tumbler around a first axis; and the releasing step comprises engaging the cocked trigger mechanism with a portion of the tumbler.

33. A method according to claim 32, wherein the engaging step comprises rotating the tumbler in a first direction to move the cocked trigger mechanism from the cocked pre-prime position to a half-cocked position, followed by the step of rotating the tumbler opposite the first direction to release the trigger mechanism from the half-cocked position.

34. A method according to claim 30, further including the step of, after drawing the negative pressure on the nozzles, blotting any primed ink from the diaphragm.

35. A method according to claim 34, wherein the blotting step includes the step of pivoting a blotter pad toward the diaphragm and into a blotting position.

36. A method according to claim 34, wherein the blotting step includes the step of camming a blotter pad into a blotting position.

37. A method according to claim 36, wherein:

the moving step comprises the steps of supporting the diaphragm with a tumbler, and rotating the tumbler in a first direction around a first axis into the priming position; and the camming step comprises the steps of engaging a blotter cam follower with a cam surface of the tumbler, and pulling the blotter pad into contact with the diaphragm during the engaging step.

38. A method according to claim 30, further including the steps of, after drawing the negative pressure on the nozzles, moving the diaphragm away from the face plate, followed by the step of wiping any primed ink from the face plate with a wiper.

39. A method according to claim 38, wherein:

the method further includes the step of supporting the wiper and the diaphragm on a single platform;

the moving step comprises moving the platform into the priming position for priming; and the wiping step comprises moving the platform to move the wiper along the face plate.

40. A method according to claim 38, further including the step of, after the wiping step, blotting any primed ink from the wiper.

41. A method according to claim 30, wherein the releasing step comprises the steps of releasing the cocked trigger mechanism, followed by the step of sealing the face plate with the diaphragm.

42. A method according to claim 30, further including the step of pushing against the face plate to separate the diaphragm from the face plate when in the cocked pre-prime position until after release of the trigger mechanism.

43. A method according to claim 30, wherein the cocking step comprises the step of engaging the trigger mechanism with the printhead.

44. A method according to claim 30, wherein the moving step comprises the step of traversing the diaphragm along a non-linear path into the priming position.

45. A method according to claim 44, wherein the moving step comprises the steps of:

supporting the diaphragm with a platform; and revolving the platform around a first axis.

46. A method according to claim 45, wherein the moving step comprises the steps of:

during the revolving step, engaging a portion of the platform with a printhead structure; and rocking the engaged platform into the priming position.

47. A method according to claim 30, wherein the method further includes the steps of:

supporting the diaphragm with a platform;

pivoting the trigger mechanism to the platform; and biasing the trigger mechanism away from the platform.

48. A method according to claim 47, wherein the cocking step comprises forcing the trigger mechanism toward the platform.

49. A method according to claim 30, wherein the method further includes the steps of:

separating the diaphragm from the face plate when in the cocked pre-prime position by pushing against the face plate until after release of the trigger mechanism;

wiping any primed ink from the face plate with a wiper after causing the negative pressure on the nozzles; and blotting any primed ink from the diaphragm after drawing the negative pressure on the nozzles.

* * * * *

UNITED STATES PATENT AND TRADEMARK OFFICE

CERTIFICATE OF CORRECTION

PATENT NO. : 5,714,991

DATED : February 3, 1998

INVENTOR(S) : Osborne et al.

It is certified that error appears in the above-identified patent and that said Letters Patent is hereby corrected as shown below:

Column 16 (line 32), delete "oberably" and insert therefor --operated--.

Column 16 (line 41), delete "operable" and insert therefor --being operated--.

Column 17 (line 50), delete "pivotally attached to said frame,", and insert the deleted phrase after "mechanism"

Column 19 (line 12), delete "pivotally attached to the platform and being operably".

Column 19 (line 13), after "mechanism" insert

UNITED STATES PATENT AND TRADEMARK OFFICE

CERTIFICATE OF CORRECTION

PATENT NO. : 5,714,991

DATED : February 3,1998

INVENTOR(S) : Osborne et al.

It is certified that error appears in the above-identified patent and that said Letters Patent is hereby corrected as shown below:

--pivotally attached to the platform and being operated--.

Column 19 (line 20), delete "pivotally attached to the platform and being engageably".

Column 19 (line 21), after mechanism insert --pivotally attached to the platform and being engaged--.

Column 19 (line 31), delete "a" and insert therefor --said--.

Column 20 (line 64), delete "drawing" and insert therefor --causing--.

Signed and Sealed this

Eighth Day of June, 1999

*Attest:*

*Attesting Officer*

Q. TODD DICKINSON

*Acting Commissioner of Patents and Trademarks*